US007497558B2

(12) United States Patent
Isono et al.

(10) Patent No.: US 7,497,558 B2
(45) Date of Patent: Mar. 3, 2009

(54) PIEZOELECTRIC ACTUATOR AND LIQUID-DROPLET JETTING HEAD

(75) Inventors: Jun Isono, Nagoya (JP); Atsushi Ito, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 11/810,006

(22) Filed: Jun. 4, 2007

(65) Prior Publication Data

US 2007/0278908 A1 Dec. 6, 2007

(30) Foreign Application Priority Data

Jun. 3, 2006 (JP) ..... 2006-155485

(51) Int. Cl.
*B41J 2/295* (2006.01)

(52) U.S. Cl. ..... 347/70; 310/364; 310/365; 310/366

(58) Field of Classification Search ..... 310/366
See application file for complete search history.

(56) References Cited

U.S. PATENT DOCUMENTS 6,595,628 B2 * 7/2003 Takagi et al. ..... 347/72
7,073,894 B2 7/2006 Isono et al.
2005/0162484 A1 * 7/2005 Isono ..... 347/68
2005/0248628 A1 * 11/2005 Isono ..... 347/71

FOREIGN PATENT DOCUMENTS

JP 2002-254634 9/2002
JP 2004-243648 9/2004
JP 2006-15539 1/2006

* cited by examiner

*Primary Examiner*—Thomas M. Dougherty
*Assistant Examiner*—Bryan P Gordon
(74) *Attorney, Agent, or Firm*—Reed Smith LLP

(57) ABSTRACT

A piezoelectric actuator includes individual inner-electrodes arranged between stacked ceramic sheets, individual surface-electrodes arranged in a row in a row-direction on a top surface of the stacked ceramic sheets, and connection electrodes connecting the individual inner-electrodes and the individual surface-electrodes respectively. The connection electrodes each have a size enough to cover one of the individual surface-electrodes respectively. The individual surface-electrodes and the connection electrodes are connected to each other via inner conduction electrodes filled through holes which are located at mutually different positions in a direction orthogonal to the row-direction of the individual surface-electrodes. With this, it is possible to make the contour of the piezoelectric actuator to be small, and to suppress the arching deformation or warpage of the piezoelectric actuator.

22 Claims, 14 Drawing Sheets

PIEZOELECTRIC ACTUATOR AND LIQUID-DROPLET JETTING HEAD

CROSS REFERENCE TO RELATED APPLICATION

The present application claims priority from Japanese Patent Application No. 2006-155485 filed on Jun. 3, 2006, the disclosure of which is incorporated herein by reference in its entirety.

BACKGROUND OF THE INVENTION

1. Field of the Invention

The present invention relates to a piezoelectric actuator and a liquid-droplet jetting head.

2. Description of the Related Art

As a conventional ink-jet head, there is known an ink-jet head having a cavity unit which is constructed by stacking a plurality of sheets and which has a plurality of pressure chambers formed and aligned in a plurality of rows therein, and a piezoelectric actuator which has active portions (energy-generating mechanism) corresponding to the pressure chambers respectively and which is joined to the cavity unit. There is known a piezoelectric actuator in which a plurality of ceramic sheets are stacked; the ceramic sheets includes a ceramic sheet having a plurality of individual electrodes formed thereon, a ceramic sheet having a common electrode which is formed thereon, which is common to the individual electrodes and which is arranged to face the individual electrodes, and a ceramic sheet stacked on the uppermost layer and which has surface electrodes formed on a surface on the ceramic sheet and connected to the individual electrodes and another surface electrode formed on the surface on the ceramic sheet and connected to the common electrode; and in which connection terminals of signal lines of a flexible flat cable, via which a driving signal is inputted, are connected to the surface electrodes and the another surface electrode. For example, see U.S. patent application Publication No. US2005/162484A1, U.S. patent application Publication No. US2005/248628 (corresponding to Japanese Patent Application Laid-open No. 2006-15539), and U.S. Pat. No. 6,595,628 (corresponding to Japanese Patent Application Laid-open No. 2002-254634).

Further, the piezoelectric actuator described in U.S. patent application Publication No. US2005/162484A1 and U.S. patent application Publication No. US2005/248628, a ceramic sheet having a connection pattern for connecting the surface electrodes and the individual electrodes is formed thereon is stacked between the ceramic sheet having the surface electrodes are formed thereon and the ceramic sheet having the individual electrodes formed thereon. In such a piezoelectric actuator, through holes penetrating through the ceramic sheets are formed and an electrically conductive material is filled in the through holes, thereby realizing the connection among the individual electrodes and the connection pattern and the surface electrodes.

On the other hand, in the piezoelectric actuator described in U.S. Pat. No. 6,595,628, the through holes are arranged so that the through holes are not arranged in one row in a direction parallel to an arrangement direction of the individual electrodes, to thereby suppress the arching deformation or warpage of the ceramic sheets, with the through holes as the base point of the arching deformation, which occurs during calcination process.

Further, the piezoelectric actuator described in U.S. patent application Publication No. US2005/162484A1, U.S. patent application Publication No. US2005/248628 and U.S. Pat. No. 6,595,628 requires a flexible flat cable in which a large number of terminals connected to a large number of surface electrodes respectively, and a large number of signal lines drawn from the terminals respectively are arranged or wired on a flat surface of the flexible cable. Therefore, in order to prevent these terminals and wirings from interfering each other and to make spacing distance among the signal lines as large as possible, it is necessary to broaden spacing distance between the terminals as much as possible. To realize the broad spacing distance, it is necessary to arrange the surface electrodes such that a spacing distance is present between the surface electrodes. In the piezoelectric actuator described in U.S. patent application Publication No. US2005/162484A1 and U.S. patent application Publication No. US2005/248628, the surface electrodes are arranged in a plurality of rows in a row direction at a arrangement pitch such that surface electrodes in a certain row are shifted, by half the arrangement pitch with respect to surface electrodes in another row adjacent to the certain row.

Further, in each of the rows of the surface electrodes, positions at which the surface electrodes are connected to the signal lines of the flexible flat cable respectively are located alternately at both end portions of the surface electrodes, the both end portions being orthogonal to the row-direction of the surface electrodes.

SUMMARY OF THE INVENTION

The piezoelectric actuator described in U.S. patent application Publication No. US2005/162484A1 and U.S. patent application Publication No. US2005/248628 is constructed such that end portions, of individual electrodes, each projecting outside an area of the individual electrode overlapping with one of the pressure chambers, the connection pattern and the surface electrodes are arranged to be coincide (overlapping) in the stacking direction of the ceramic sheets; and that through holes are formed to connect the end portions of the individual electrodes, the connection pattern and the surface electrodes. The through holes are formed at positions which are alternately shifted per each of the ceramic sheets so that each of the through holes does not penetrate a plurality of ceramic sheets. Here, only a minimum area, for filling the electrically conductive material in each of the through holes, is secured for each of the end portions, of individual electrodes, each projecting outside the area of the individual electrode overlapping with one of the pressure chambers, and for the connection pattern. Therefore, since a shift amount, by which the through holes are formed to be shifted from each other, can only be secured by a small amount, there is a fear that the strength of each of the ceramic sheets is insufficient at positions at which the through holes are formed. Moreover, as in a piezoelectric actuator described in "Description of Related Art" section in U.S. Pat. No. 6,595,628, there is a fear that arching deformation or warpage of the actuator as a whole occurs during the calcination process, with the through holes as the base point of the arching deformation, similarly to the piezoelectric actuator in which the through holes are arranged in one row. In case of the piezoelectric actuator as described in U.S. Pat. No. 6,595,628 in which the individual electrodes are arranged in two rows, the through holes can be arranged outside the rows of the individual electrodes respectively, without arranging the through holes in one row. However, in this case, the actuator becomes great in size. Further, in the piezoelectric actuator, as described in U.S. patent application Publication No. US2005/162484A1 and U.S. patent application Publication No. US2005/248628, the pressure chambers are arranged in a plurality of rows. In such a case, the actuator becomes much greater in size. In the recent years, there is a demand for increasing the recording speed and for realizing higher resolution. When an attempt is made to increase the number of the nozzles to satisfy this demand, the ceramics sheets are required to have greater size, which in turn makes shrinkage caused by the calcination to be great, making it difficult to produce the piezoelectric actuator with high precision.

An object of the present invention is to provide a piezoelectric actuator and a liquid-droplet jetting head which can improve degree of freedom in the connection between the surface electrode and the connection pattern, which can realize a compact contour for the piezoelectric actuator and the liquid-droplet jetting head, and in which arching deformation hardly occurs.

According to a first aspect of the present invention, there is provided a piezoelectric actuator on which connection terminals of signal lines transmitting a drive signal to the piezoelectric actuator are connected, the actuator including: a plurality of ceramic sheets which are stacked in a predetermined stacking direction;

a plurality of individual inner-electrodes which are arranged in a row in a predetermined row-direction between the ceramic sheets; a common inner-electrode which is arranged to face the individual inner-electrodes so that one ceramic sheet, among the ceramic sheets, is sandwiched between the common inner-electrode and the individual inner-electrodes; a plurality of individual surface-electrodes which are arranged on a top surface of the stacked ceramic sheets, and which are connected to the individual inner-electrodes respectively; a common surface-electrode which is arranged on the top surface of the stacked ceramic sheets, and which is connected to the common inner-electrode; and a plurality of connection-electrodes which are arranged on another ceramic sheet, among the ceramic sheets, between the individual surface-electrodes and the individual inner-electrodes, which face in parallel to the individual surface-electrodes respectively in the stacking direction, and which are arranged in a row in the row-direction corresponding to the individual surface-electrodes respectively, each of the connection-electrodes connecting one of the individual surface-electrodes and one of the individual inner-electrodes, and having an area enough to cover one of the individual surface-electrodes corresponding to each of the connection-electrodes; wherein two individual surface-electrodes, among the plurality of individual surface-electrodes, which are adjacent to each other in the row-direction, are connected to two connection electrodes, among the plurality of connection electrodes, corresponding to the two individual surface-electrodes, at mutually different positions in an orthogonal direction orthogonal to the row-direction, respectively.

According to the first aspect of the present invention, the plurality of connection electrodes, connecting the individual surface-electrodes and the individual inner-electrodes respectively, are arranged on a certain ceramic sheet stacked between the ceramic sheets between the individual surface-electrodes and the individual inner-electrodes. Further, the plurality of individual surface-electrodes and the plurality of connection electrodes face each other and are arranged in parallel to each other in the stacking direction, and the plurality of individual surface-electrodes and the plurality of connection electrodes are connected such that individual surface-electrodes, among the plurality of individual surface-electrodes, which are adjacent to each other in the row-direction, are connected to connection electrodes, among the plurality of connection electrodes, corresponding to the two adjacent individual surface-electrodes, at mutually different positions in the orthogonal direction orthogonal to the row-direction of the plurality of individual surface-electrodes and the plurality of connection electrodes. Accordingly, it is possible to arrange connection positions, at which the connection electrodes and the individual surface-electrodes are connected respectively, in a dispersing or non-concentrated manner, regardless of connection position at which the individual inner-electrodes and the connection electrodes are connected respectively. Accordingly, there is no fear that there is shortage in the strength of the ceramic sheet or sheets at the connection positions, and it is possible to suppress the deformation of the ceramic sheet or sheets at the connection portions. Further, even when the number of the nozzles is increased for satisfying the demand in the recent years for increasing the recording speed and realizing higher resolution, there is no need to secure, outside the row of the individual inner-electrodes, wide connection area for the electrode connection, as required in the conventional actuator. Therefore, it is possible to make the piezoelectric actuator to be compact easily.

Here, since the above-described connection electrodes are used for connecting the individual surface-electrodes and the individual inner-electrodes, there is no limit with respect to the shape of the connection electrodes. Therefore, by arranging the each of the connection electrodes to face and to be in parallel to one of the individual surface-electrodes in the stacking direction, each of the individual surface-electrodes is made to substantially overlap in a plan view with one of the connection electrodes. This makes it possible to connect the individual surface-electrodes with the connection electrodes respectively, at any portion of each of the individual surface-electrodes, by using the through holes regardless of positional relationship between the individual inner-electrodes and the connection electrodes.

In the piezoelectric actuator of the present invention, the individual surface-electrodes may be connected to the connection terminals of the signal lines at positions corresponding to connection portions of the individual surface-electrodes at which the individual surface-electrodes are connected to the connection electrodes, respectively.

In this case, the individual surface-electrodes are connected to the connection terminals of the signal lines at positions each corresponding to one of the connection portions at which the individual surface-electrodes are connected to the connection electrodes. Accordingly, the connection portion of each of the individual surface-electrodes, at which the individual surface-electrode is connected to one of the connection electrodes, is directly connected to one of the connection terminals of the signal lines, thereby enhancing the reliability in electrical connection. In addition, since the individual surface-electrodes and the connection terminals are connected respectively at mutually different positions in the orthogonal direction orthogonal to the row-direction of the individual surface-electrodes, it is possible to secure a wide spacing distance between the connection portions of the individual surface electrodes, thereby making it possible to arrange a large number of signal lines between the spacing distance. This consequently makes it possible to provide a large number of the individual surface-electrodes or to arrange the individual surface-electrodes highly densely or highly integrated manner.

In the piezoelectric actuator of the present invention, the individual surface-electrodes and the connection electrodes may extend in the orthogonal direction; and joining electrodes connected to the connection terminals of the signal lines may be formed on the individual surface-electrodes at the positions corresponding to the connection portions.

In this case, the joining electrodes connected to the connection terminals of the signal lines are provided on the individual surface-electrodes at the positions corresponding to the connection portions at which the individual surface-electrodes are connected to the connection electrodes respectively. Accordingly, by connecting the connection terminals of the signal lines to the joining electrodes, it is possible to easily and reliably connect the connection terminals of the signal lines to the connection portions of the individual surface-electrodes connected to the connection terminals respectively.

In the piezoelectric actuator of the present invention, the connection electrodes may have portions which face the common inner-electrode located on a side opposite to the individual surface-electrodes, area of the portions being same among the connection electrodes.

In this case, the connection electrodes extend in the orthogonal direction orthogonal to the row-direction, and the area of the portions, of the connection electrodes, which face the common inner-electrode located on a side opposite to the individual surface-electrodes, is same among the connection electrodes. Accordingly, the electrostatic capacitance generated between the plurality of connection electrodes and the common inner-electrode is uniform among the plurality of connection electrodes, thereby making it possible to make the characteristic of the piezoelectric actuator to be uniform among the individual surface-electrodes.

In the piezoelectric actuator of the present invention, the plurality of ceramic sheets may include a first ceramic sheet having the individual inner-electrodes formed thereon, a second ceramic sheet having the common inner-electrode formed thereon, a third ceramic sheet having the individual surface-electrodes and the common surface-electrode formed thereon, and a fourth ceramic sheet having the connection electrodes formed thereon; and through holes may be formed in the individual inner-electrodes and the connection electrodes respectively, and an electrically conducted material may be filled in the through holes to connect between the individual inner-electrodes and the connection electrodes respectively.

In this case, the individual inner-electrodes and the connection electrodes are connected in the stacking direction and the individual surface-electrodes and the connection electrodes are connected in the stacking direction by the electrically conducted material filled in the through holes respectively, the through holes penetrating through the ceramic sheets between these electrodes. Therefore, by stacking the ceramic sheets, these electrodes can be connected easily. Further, it is possible to freely arrange the connection positions at which the connection electrodes and the individual surface-electrodes are connected respectively, the connection positions being mutually different in the orthogonal direction orthogonal to the row-direction. Therefore, it is possible to make the spacing distance between the through holes to be great, thereby making it possible to suppress the deformation or warpage of ceramic sheet or sheets due to the calcination.

In the piezoelectric actuator of the present invention, a cavity unit may be joined to a bottom surface, of the stacked ceramic sheets, which is on a side opposite to the top surface, the cavity unit including a plurality of nozzles each jetting a liquid-droplet of a liquid and a plurality of pressure chambers corresponding to the nozzles respectively and being arranged in a row; and the individual inner-electrodes may be arranged to face the pressure chambers respectively, and when a voltage is applied between the individual inner-electrodes and the common inner-electrode, portions of at least one of the first and second ceramic sheets between the individual inner-electrodes and the common inner-electrode to which the voltage is applied may be displaced to impart jetting pressure to the liquid in the pressure chambers.

In this case, in the piezoelectric actuator joined to the cavity unit having the pressure chambers arranged in a row corresponding to the nozzles each jetting the liquid droplet, it is possible to increase the degree of freedom in connecting the individual surface-electrodes and the individual inner-electrodes by using the connection electrodes. Even when the number of the nozzles is increased for satisfying the demand for increasing the recording speed and realizing higher resolution, there is no need to secure, outside the row of the individual inner-electrodes, wide connection area for the electrode connection, as required in the conventional actuator. Therefore, it is possible to make the cavity unit to be compact easily together with the piezoelectric actuator.

In the piezoelectric actuator of the present invention, the pressure chambers may be arranged in a plurality of rows in the cavity unit; the individual inner-electrodes may be arranged in a plurality of rows corresponding to the rows of the pressure chambers respectively; the common inner-electrode may face the rows of the individual inner-electrodes in the stacking direction and may extend in the row-direction in which the rows of the individual inner-electrodes extend; the connection electrodes may be arranged in a plurality of rows and the individual surface-electrodes may be arranged in a plurality of rows corresponding to the rows of the individual inner-electrodes; and the common surface-electrode may extend, in a same plane with the individual surface-electrodes, along an end portion of the third ceramic sheet which is orthogonal to the row-direction.

In this case, the connection between the common surface-electrode and the common-inner electrode is secured to thereby increase the degree of freedom in connecting the individual surface-electrodes and the individual inner-electrodes by using the connection electrodes. Further, even when the number of the nozzles is increased for satisfying the demand for increasing the recording speed and realizing higher resolution, it is possible to make the cavity unit to be compact easily together with the piezoelectric actuator.

In the piezoelectric actuator of the present invention, the joining electrodes may be arranged in a row in a staggered manner in the orthogonal direction. In this case, since the joining electrodes are arranged in a row in a staggered manner in the orthogonal direction, a spacing distance can be defined between the joining electrodes, thereby making it possible to secure wide spacing distance between the connection terminals, of the signal lines, connected to the joining electrodes respectively.

In the piezoelectric actuator of the present invention, the connection electrodes may extend in the orthogonal direction;

the plurality of individual surface-electrodes may be arranged such that adjacent individual surface-electrodes, among the plurality of individual surface-electrodes, which are mutually adjacent are located on the top surface at positions which are mutually different in the orthogonal direction respectively; and the adjacent individual surface-electrodes may face each of the connection electrodes at positions of each of the connection electrodes which are mutually different in the orthogonal direction respectively. In this case, by connecting the connection terminals of the signal lines to the joining electrodes, it is possible to connect the connection terminals of the signal lines to the joining electrodes highly reliably and easily at connection portions of the individual surface-electrodes at which the connection electrodes are joined to the individual surface-electrodes respectively.

In the piezoelectric actuator of the present invention, the joining electrodes may be formed on the individual surface-electrodes at positions corresponding to the connection portions. In this case, the joining electrodes connected to the connection terminals of the signal lines are provided on the individual surface-electrodes at the positions corresponding to the connection portion at which the individual surface-electrodes are joined to the connection electrodes respectively. Accordingly, by connecting the connection terminals of the signal lines to the joining electrodes, it is possible to join the connection terminals of the signal lines to the individual surface-electrodes highly reliably and easily at the positions corresponding to the connection portions of the individual surface-electrodes at which the individual surface-electrodes are connected to the connection electrodes respectively.

In the piezoelectric actuator of the present invention, the joining electrodes may be arranged in a row in a staggered manner in the orthogonal direction; and each of the individual surface-electrodes may be formed to have a length and a width in the row-direction which are greater than those of one of the joining electrodes. In this case, the joining electrodes are arranged in a row in a staggered manner in the orthogonal direction; and each of the individual surface-electrodes is formed to have a length and a width in the row-direction which are greater than those of one of the joining electrodes. Accordingly, upon joining the connection terminals of the signal lines to the joining electrodes by using an electrically conductive blazing material such as solder and even when the blazing material flows, it is possible to stop (confine) the blazing material on each of the individual surface-electrodes, thereby preventing the blazing material on a certain individual surface-electrode from outflowing to another individual surface-electrode adjacent to the certain individual surface-electrode, and to consequently prevent the electrical short circuit between the adjacent individual surface-electrodes.

In the piezoelectric actuator of the present invention, each of the individual surface-electrodes may have a length in the row-direction which is greater than a spacing distance in the row-direction between the individual surface-electrodes. In this case, since each of the individual surface-electrodes has the length in the row-direction which is greater than the spacing distance in the row-direction between the individual surface-electrodes, it is possible to secure the length in the row-direction of each of the individual surface-electrodes as great as possible, thereby increasing allowance for the positioning deviation of the joining electrodes with respect to the individual surface-electrodes.

In the piezoelectric actuator of the present invention, each of the plurality of individual surface-electrodes may have end portions, and the adjacent individual surface-electrodes may overlap in the orthogonal direction at the end portions thereof. In this case, since each of the plurality of individual surface-electrodes has end portions and the adjacent individual surface-electrodes overlap in the orthogonal direction at the end portions thereof, it possible to increase the allowance for the positioning deviation of the joining electrodes with respect to the individual surface-electrodes.

According to a second aspect of the present invention, there is provided a liquid-droplet jetting head which jets a liquid-droplet of a liquid, including: a cavity unit having a plurality of nozzles each of which jets the liquid-droplet, and a plurality of pressure chambers which correspond to the nozzles respectively and which are arranged in a row at a predetermined pitch in a predetermined row-direction; and a piezoelectric actuator which is joined to the cavity unit, including: a first ceramic sheet on which a plurality of individual inner-electrodes are arranged in a row corresponding to the pressure chambers respectively; a second ceramic sheet which is stacked on the first ceramic sheet and on which a common inner-electrode is formed, the common inner-electrode being common to the pressure chambers and facing the individual inner-electrodes; a third ceramic sheet which is stacked on an outermost layer of the stacked first and second ceramic sheets, and on which a plurality of individual surface-electrodes connected to the individual inner-electrodes respectively and a common surface-electrode connected to the common inner-electrode are formed; and a fourth ceramic sheet which is stacked between the first and third ceramic sheets and on which a plurality of connection electrodes are formed, the connection-electrodes each connecting one of the individual surface-electrodes and one of the individual inner-electrodes, and each having an area enough to cover one of the individual surface-electrodes; wherein two individual surface-electrodes, among the plurality of individual surface-electrodes, which are adjacent to each other in the row-direction, are connected to two connection electrodes, among the plurality of connection electrodes, corresponding to the two adjacent inner surface-electrodes, at mutually different positions in an orthogonal direction orthogonal to the row-direction, respectively.

According to the second aspect of the present invention, the plurality of connection electrodes, connecting the plurality of individual surface-electrodes and the plurality of individual inner-electrodes respectively, are arranged on the fourth ceramic sheet stacked between the first and third ceramic sheets; and the plurality of individual surface-electrodes and the plurality of connection electrodes are arranged such that individual surface-electrodes, among the plurality of individual surface-electrodes, which are adjacent to each other in the row-direction, are connected to connection electrodes among the plurality of connection electrodes corresponding to the mutually adjacent individual surface-electrodes, at mutually different positions in the orthogonal direction orthogonal to the row-direction. Accordingly, it is possible to arrange connection positions, at which the individual surface-electrodes and the individual inner-electrodes are connected respectively by using the connection electrodes, in a dispersing manner regardless of the location of connection position at which the individual inner-electrodes and the connection electrodes are connected. Accordingly, there is no fear that there is shortage in the strength of the ceramic sheet or sheets at the connection positions, and it is possible to suppress the deformation of the ceramic sheet(s) at the connection positions. Further, even when the number of the nozzles and the number of individual surface-electrodes are increased for satisfying the demand in the recent years for increasing the recording speed and realizing higher resolution, there is no need to secure, outside the row of the individual inner-electrodes, wide connection area for the electrode connection, as required in the conventional actuator. Therefore, it is possible to make the piezoelectric actuator to be compact easily.

The liquid-droplet jetting head of the present invention may further include signal lines which transmit, to the piezoelectric actuator, a driving signal for driving the piezoelectric actuator, and which has connection terminals connected to the individual surface-electrodes and the common surface-electrode. In this case, since the signal lines have terminals connected to the individual surface-electrodes and the common surface-electrode, it is possible to realize the electrical connection to the piezoelectric actuator reliably.

In the liquid-droplet jetting head of the present invention, the connection electrodes may include first portions, second portions, and third portions respectively, the first portions being arranged in the row-direction at a pitch, each of the first portions facing one of the individual surface-electrodes in the stacking direction and being connected to one of the individual surface-electrodes, each of the second portions facing one of the individual inner-electrodes in the stacking direction, being connected to one of the individual inner-electrodes, and being arranged in the row-direction to be shifted with respect to one of the first portions by half the pitch, and the third portions connecting the first portions and the second portions respectively.

In this case, since the connection electrodes are provided with the first portions, the second portions, and the third portions respectively, the first portions being arranged in the row-direction at a pitch, each of the first portions facing one of the individual surface-electrodes in the stacking direction and being connected to one of the individual surface-electrodes, each of the second portions facing one of the individual inner-electrodes in the stacking direction, being connected to one of the individual inner-electrodes, and being arranged in the row-direction to be shifted with respect to one of the first portions by half the pitch, and the third portions connecting the first portions and the second portions respectively. Accordingly, even when, in each of the individual inner-electrodes, a portion electrically connected to one of the individual surface-electrodes and another portion corresponding to one of the pressure chambers are arranged closely to each other to an extent that does not adversely influence the electrical conduction, it is possible to absorb the shift by half the pitch between the individual surface-electrodes and the individual inner-electrodes by separating, in each of the connection electrodes which do not contribute to the displacement, the first portion connected to one of the individual surface-electrodes and the second portion connected to one of the individual inner-electrodes. Thus, the entire length of each of the individual inner-electrodes can be shortened, which is advantageous for arranging the electrodes highly densely or making the electrodes to be compact.

DESCRIPTION OF THE PREFERRED EMBODIMENTS

Figure 1:
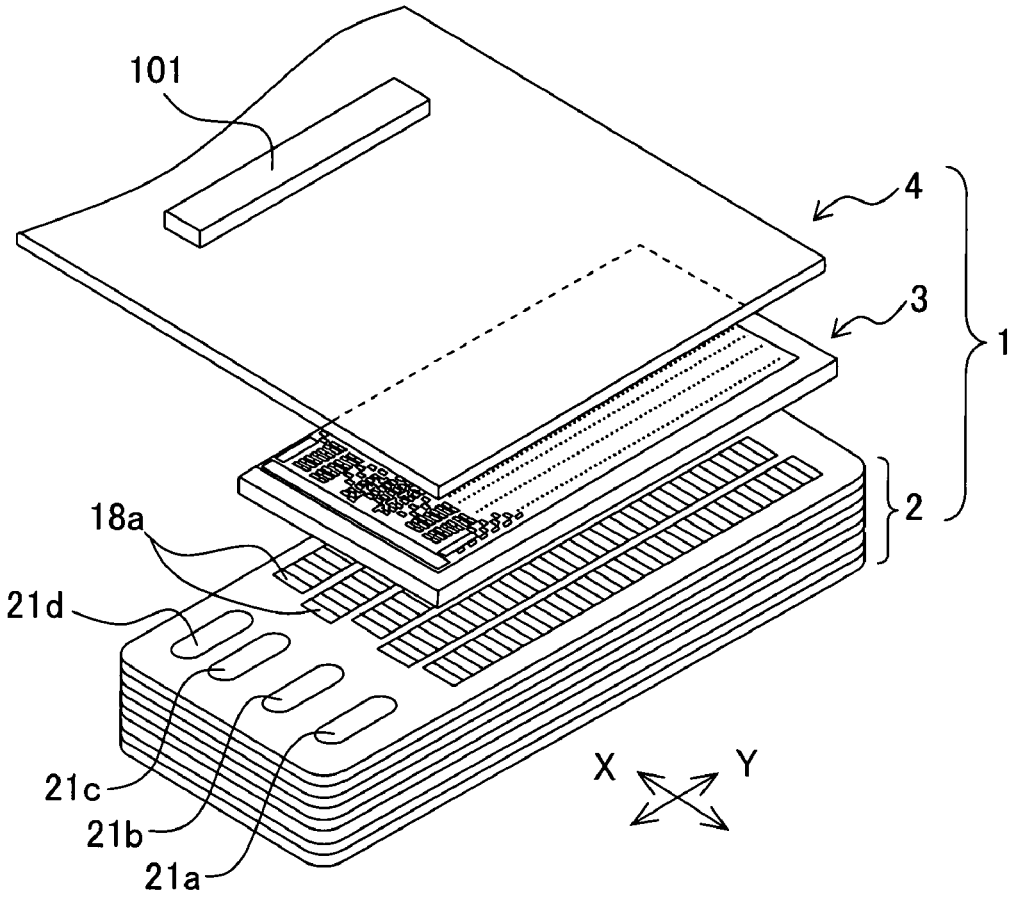
FIG. 1 is an exploded perspective view showing a cavity unit, a piezoelectric actuator and a flat cable of a piezoelectric ink-jet head of the present invention in a state that the cavity unit, the piezoelectric actuator and the flat cable are separated from one another.

In the following, an embodiment of the present invention will be explained with reference to the drawings. Note that an ink-jet head including the piezoelectric actuator according to the embodiment is an ink-jet head for color recording. Although not specifically shown in the drawings, the ink-jet head is provided on a carriage which reciprocates in an X-direction (main scanning direction) which is orthogonal to a Y-direction (sub-scanning direction) as a transport direction of a recording paper. For example, four color inks (cyan, magenta, yellow and black inks) are supplied to the ink-jet head from ink cartridges provided on the carriage or from ink tanks arranged in the body of the printer, via ink supply pipes and damper tanks provided on the carriage.

Figure 2:
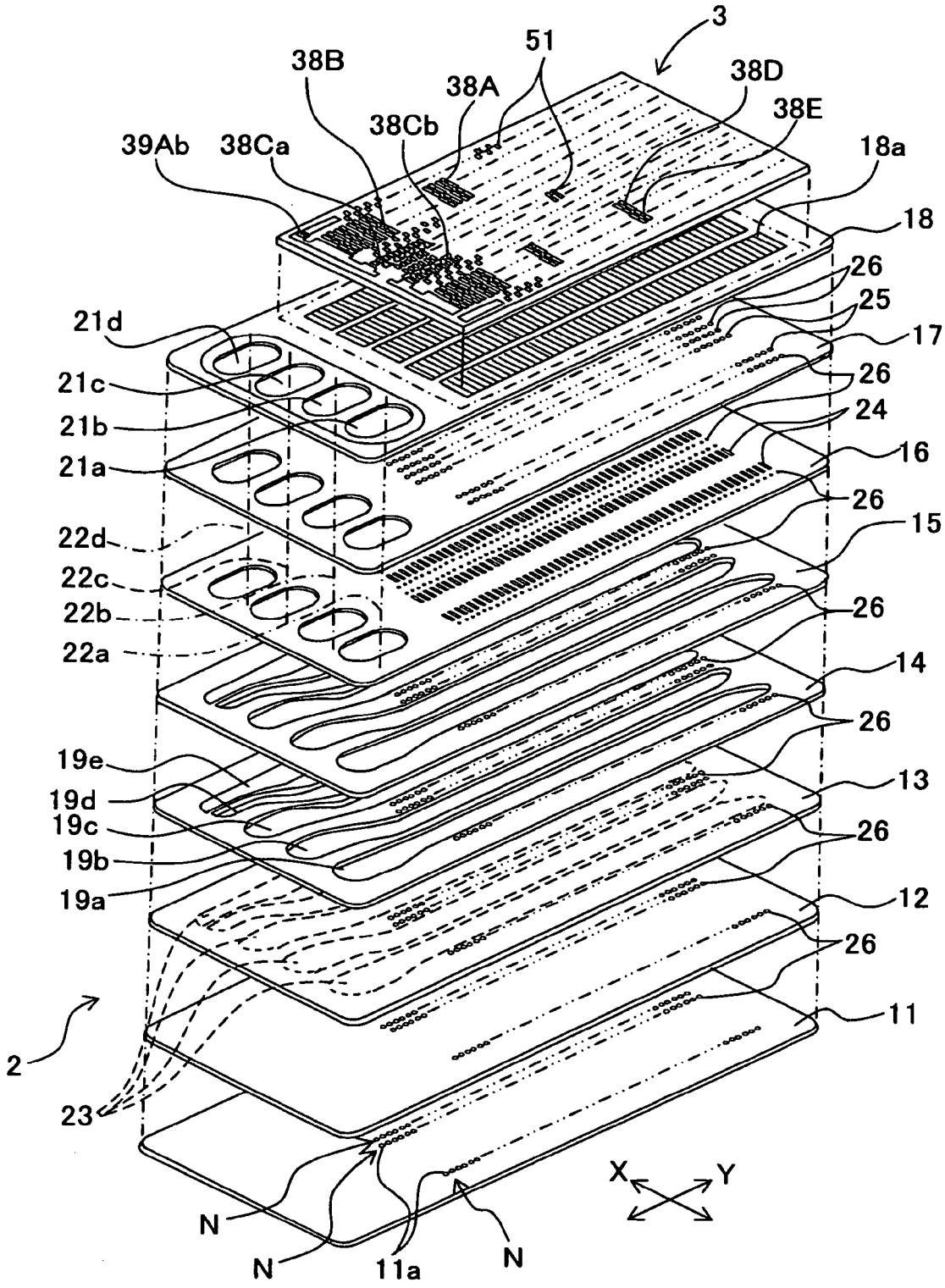
FIG. 2 is an exploded perspective view of the cavity unit.
Figure 3:
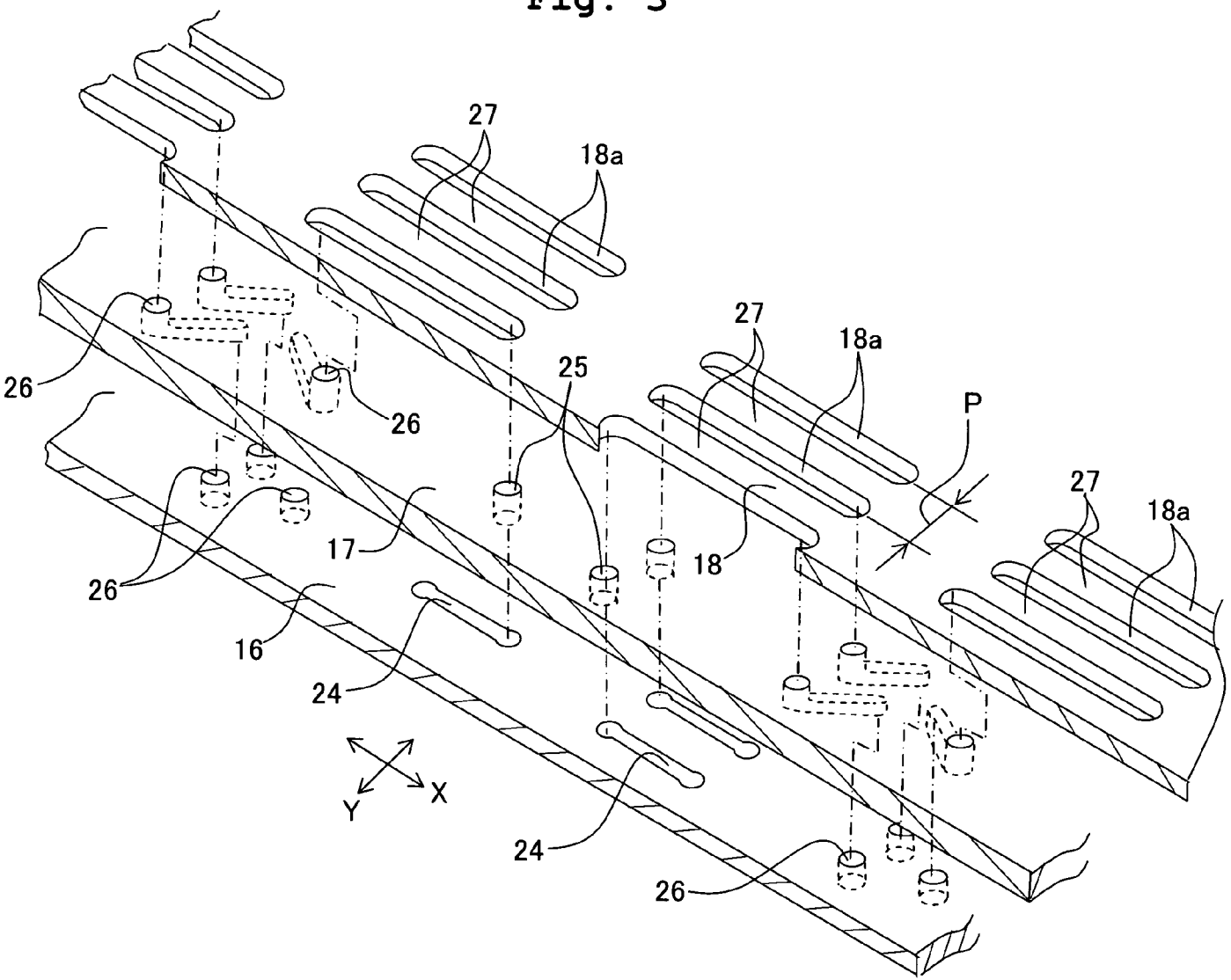
FIG. 3 is an exploded perspective view of a part of the cavity unit.

FIG. 1 is an exploded perspective view showing a state in which a flexible flat cable is joined to the upper surface of an ink-jet head to which the present invention is applied; FIG. 2 is a perspective view showing the cavity unit and the like; and FIG. 3 is a partial perspective view showing main components of the cavity unit in an enlarged manner.

As shown in FIG. 1, an ink-jet head 1 is provided with a cavity unit 2 having a plurality of pressure chambers formed and arranged in a plurality of rows in the cavity unit 2, and a plate-type piezoelectric actuator 3 which is adhered onto the cavity unit 2. A flexible flat cable 4 via which a driving signal is inputted is joined to the upper surface of the piezoelectric actuator 3. The pressure chambers correspond to a plurality of nozzles which jet ink droplets (liquid droplets), respectively.

The cavity unit 2 is a stacked body (laminated body) in which eight pieces of plates are stacked and adhered onto one another. As shown in FIG. 2, the cavity unit 2 includes, in a order from bottom up, a nozzle plate 11, a cover plate 12, a damper plate 13, a lower manifold plate 14, an upper manifold plate 15, a lower spacer plate 16, an upper spacer plate 17, and a base plate 18 in which pressure chambers 18*a* are formed. The nozzle plate 11 is made of a synthetic resin material, and the remaining plates 12 to 18 are each made of 42% nickel alloy steel plate. Each of the plates 11 to 18 has a thickness of about 50 μm to 150 μm.

In the nozzle plate 11 forming the lower surface of the cavity unit 2, five nozzle rows N (FIG. 2 shows only three of the nozzle rows N). Each of the nozzle rows N includes a large number of nozzles 11*a* which are arranged in the Y-direction and which jet the ink. Each of the nozzles 11*a* has a hole diameter of about 25 μm.

In each of the lower and upper manifold plates 14 and 15, five through holes elongated in the Y-direction are formed to penetrate the plate in the thickness direction thereof, corresponding to the nozzle rows N respectively. The manifold plates 14 and 15 are sandwiched by the lower space plate 16 and the damper plate 13, so that the five through holes form five manifold chambers 19*a*, 19*b*, 19*c*, 19*d* and 19*e* (common ink chambers). Note that the manifold chambers 19*a*, 19*b* and 19*c* are for the cyan ink (C), yellow ink (Y) and magenta ink (M) respectively, and the manifold chambers 19*d* and 19*e* are for the black ink (BK).

In FIG. 2, four ink supply holes 21*a*, 21*b*, 21*c* and 21*d* are aligned in a row in the base plate 18 at one end portion in the Y-direction of the base plate 18. The ink supply holes 21*a*, 21*b* and 21*c* are used for supplying the inks to the manifold chambers 19*a*, 19*b* and 19*c* respectively; and the ink supply hole 21*d* is used for supplying the ink to the two manifold chambers 19*d* and 19*e*. As shown in FIG. 2, ink supply channel 22*a*, 22*b*, 22*c* and 22*d* are formed in each of the upper and lower spacer plates 17 and 16 at an end portion thereof. Upstream-side ends of the ink supply channel 22*a* to 22*d* are communicated with the ink supply holes 21*a* to 21*d* respectively. A downstream-side end of each of the ink supply channel 22*a*, 22*b* and 22*c* is communicated with one end of one of the manifold chambers 19*a*, 19*b* and 19*c* to which the ink supply channel corresponds; and a downstream-side end of the ink supply channel 22*d* is communicated with one ends of the manifold chambers 19*d* and 19*e*.

Further, five recesses are formed in the lower surface of the damper plate 13. The recesses are open downwardly and have shapes corresponding in a plan view to the manifold chambers 19*a* to 19*e*, respectively. The openings of the recesses are closed by the cover plate 12 to thereby define damper chambers 23 in a closed state. When the piezoelectric actuator 3 is driven, although pressure wave is propagated to the pressure chambers 18*a*, a component (backward-moving component) of the pressure wave toward the manifold chambers 19*a* to 19*e* is absorbed by the vibration of thin-walled portions of the damper chambers 23, thereby making it possible to prevent the occurrence of so-called crosstalk.

As shown in FIG. 3, throttles 24 are formed in the lower spacer plate 16 corresponding to the nozzles 11*a* in each of the nozzle rows N respectively. Each of the throttles 24 is a slim recess extending in the X-direction. An end of each of the throttles 24 is communicated with one of the manifold chambers 19*a* to 19*e* in the upper manifold plate 15 to which the throttle 24 correspond, and the other end of each of the throttles 24 is communicated, in the upper spacer plate 17, with one of communication holes 25 penetrating through the upper spacer plate 17 in the up and down direction.

Communication channels 26, which are communicated with the nozzles 11*a* in each of the nozzle rows N, are formed in each of the cover plate 12, damper plate 13, upper and lower manifold plates 14, 15, and lower and upper spacer plates 16, 17 to penetrate through the plate in up and down direction, at positions at which the communication channels 26 do not overlap with any of the manifold chambers 19*a* to 19*e* or any of the damper chambers 23 in the up and down direction.

In the base plate 18, the pressure chambers 18*a* are formed to be elongated in the X-direction and to penetrate through the base plate 18 in the thickness direction thereof. The pressure chambers 18*a* correspond to the nozzles 11*a* respectively, and the pressure chambers 18*a* are arranged to form rows (pressure-chamber rows) corresponding to the nozzle rows N. One ends in the longitudinal direction of the pressure chambers 18*a* are communicated with the communication holes 25 in the upper spacer plate 17 respectively; and the other ends in the longitudinal direction of the pressure chambers 18*a* are communicated with the communication channels 26 which are formed in each of the plates 12 to 17 to penetrate therethrough. As shown in FIG. 3, the pressure chambers 18*a* in each of the pressure-chamber rows are arranged in the Y-direction at a predetermined pitch P with partition walls 27 being intervened therebetween. A pressure chamber 18*a* in a certain pressure-chamber row among the pressure-chamber rows is arranged to be shifted by a half the pitch P (P/2) with respect to another pressure chamber 18*a* belonging to another pressure-chamber row adjacent to the certain pressure-chamber row. Namely, the pressure-chamber rows are arranged in a staggered manner from one another.

Accordingly, the inks, supplied from the ink supply holes 21*a* to 21*d* inflow to the manifold chambers 19*a* to 19*e* respectively, and then flow through the throttles 24 and the communication holes 25 to be distributed to the pressure chambers 18*a*. Then, the inks flow through the pressure chambers 18*a* to the communication channels 26 respectively, then reach to the nozzles 11*a* corresponding to the pressure chambers 18*a* respectively, and the inks are jetted as liquid droplets (ink droplets) from the nozzles 11*a*.

Figure 4:
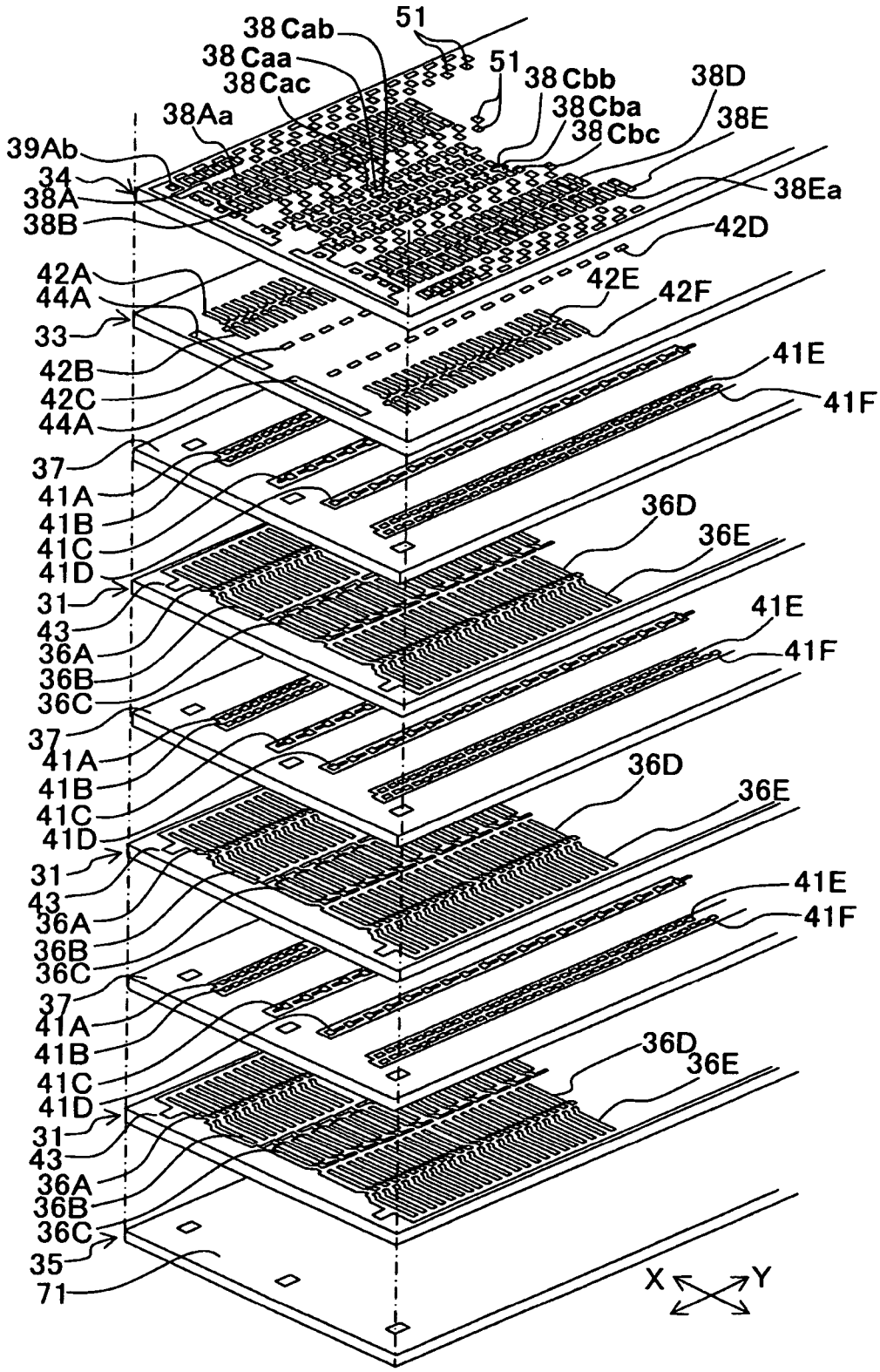
FIG. 4 is an exploded perspective view of the piezoelectric actuator in which a part of the piezoelectric actuator is omitted.

As shown in FIG. 4, the piezoelectric actuator 3 includes three pieces of first ceramic sheets 31 each of which has a pattern of individual inner-electrodes 36A, 36B, 36C, 36D and 36E formed on a surface thereof; three pieces of second ceramic sheets 32 each of which has a pattern of a common inner-electrode 37 formed on a surface thereof; a dummy ceramic sheet 33 for the electric conduction (fourth ceramic sheet; conduction-dummy ceramic sheet 33); a top ceramic sheet (third ceramic sheet) 34 which has individual surface-electrodes 38A, 38B, 38C, 38D and 38E formed on a surface thereof and common surface-electrodes 39A, 39B formed on the surface thereof; and a bottom ceramic sheet 35 having a common inner-electrode 37B formed entirely on the upper surface thereof. Three pieces of the first ceramic sheets 31 and three pieces of the second ceramic sheets 32 are alternately stacked onto one another; the conduction-dummy ceramic sheet 33 is stacked on the alternately stacked first and second ceramic sheets 31, 32; and the top ceramic sheet 34 is further stacked on the conduction-dummy ceramic sheet 33. Furthermore, the bottom ceramic sheet 35 is stacked, as the lowermost layer, below the stacked portion in which the first and second ceramic sheets 31, 32 are stacked. Here, the conduction-dummy ceramic sheet 33 and the top ceramic sheet 34 function as restricting layers (regulating layers). Namely, when active portions of the first and second ceramic sheets 31 and 32 are displaced as will be described later on, the conduction-dummy ceramic sheet 33 and the top ceramic sheet 34 function to suppress the displacement of the active portions in a direction opposite to the pressure chambers 18*a* and to direct the displacement of the active portions more to a direction toward the pressure chambers 18*a*.

These ceramic sheets 31 to 35 are formed as follows. First, green sheets are formed by preparing a mixture liquid of lead zirconate titanate (PZT ($PbTiO_3$—$PbZrO_3$))-based ceramic powder which is ferroelectric, a binder and a solvent, and spreading the mixture liquid to a sheet-like shape, and by performing drying therefor. An electrically conductive material (Ag—Pd based conductive paste) is coated on the green sheets by the screen printing or the like to thereby form the respective electrodes as described above. Then, these green sheets are stacked together and calcinated to be integrated. Afterwards, a high voltage is applied between the individual inner-electrodes and the common inner-electrode to polarize the ceramic sheets at portions thereof sandwiched between the individual inner-electrodes and the common inner-electrode. With this, so-called piezoelectric characteristic (property to be displaced by the application of drive voltage) is imparted to the polarized portions of the ceramic sheets. Note that each of the ceramic sheets 31 to 35 has a thickness of about 30 μm. Further, it is enough that conduction-dummy ceramic sheet 33, the top ceramic sheet 34 and the bottom ceramic sheet 35 have the insulating property. Accordingly, these sheets 33 to 35 may be formed of a material exhibiting no piezoelectric characteristic.

Figure 5:
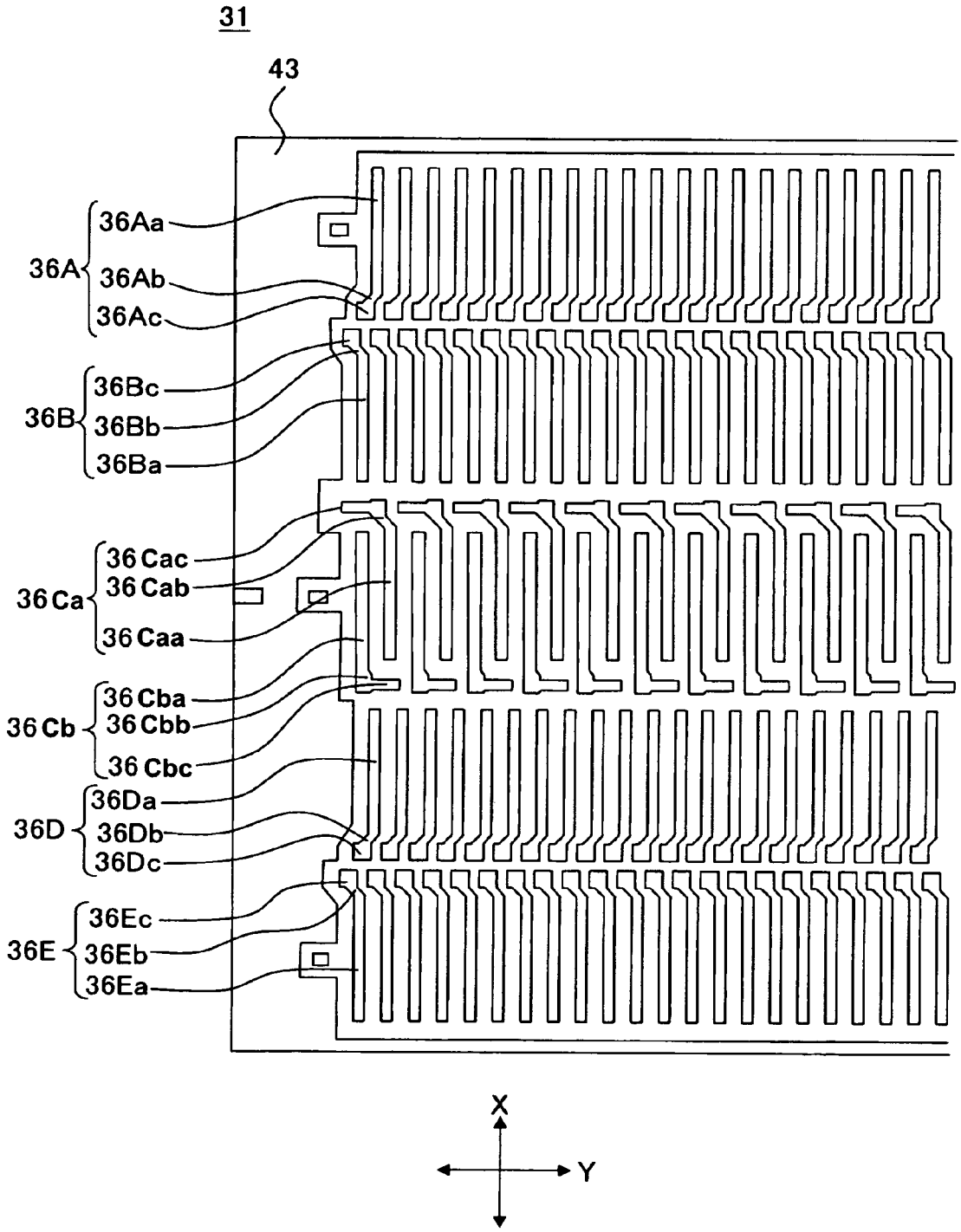
FIG. 5 is a plan view of a first piezoelectric ceramic sheet in which a part of the first piezoelectric ceramic sheet is omitted.

As shown in FIG. 5, on a surface of each of the first ceramic sheets 31, the individual inner-electrodes (first electrodes) 36A to 36E are formed and arranged in five rows corresponding to the pressure chambers 18*a* arranged in five rows, respectively. The individual inner-electrodes 36A to 36E have linear portions 36Aa to 36Ea, bent portions 36Ab to 36Eb extending from one ends of the linear portions 36Aa to 36Ea respectively, and conduction portions 36Ac to 36Ec having a rectangular shape and connected to the bent portions 36Ab and 36Eb, respectively. Each of the linear portions 36Aa to 36Ea has an approximately same length as that of one of the pressure chambers 18*a* and overlaps with one of the pressure chambers 18*a* in a plan view. Further, each of the linear portions 36Aa to 36Ea has a width slightly narrower than that of one of the pressure chambers 18*a*.

The individual inner-electrodes 36C arranged in the center in the first ceramic sheet 31 include two kinds of individual inner-electrodes, namely individual inner-electrodes 36Ca and 36Cb. The individual inner-electrodes 36Ca and 36Cb are formed such that the conduction portions 36Cac and 36Cbc extend alternately in mutually opposite directions from one ends of the linear portions 36Caa and 36Cba respectively, the one ends corresponding to outer end portions of the pressure chambers 18*a* respectively, via the bent portions 36Cab and 36Cbb extending outwardly from the linear portions 36Caa and 36Cba, respectively.

The individual inner-electrodes 36B, 36D arranged in rows outside the individual inner-electrodes 36Ca and 36Cb respectively are formed such that the conduction portions 36Bc, 36Dc are connected to one ends of the linear portions 36Ba, 36Da respectively, the one ends corresponding to outer end portions of the pressure chambers 18*a*, via the bent portions 36Bb, 36Db extending outwardly from the linear portions 36Ba, 36Da, respectively. The individual inner-electrodes 36A, 36E arranged in rows outside the individual inner-electrodes 36B and 36D respectively are formed such that the conduction portions 36Ac, 36Ec are connected to one ends of the linear portions 36Aa, 36Ea respectively, the one ends corresponding to inner end portions of the pressure chambers 18*a*, via the bent portions 36Ab, 36Eb extending outwardly from the linear portions 36Aa, 36Ea, respectively. As shown in FIG. 5, the conduction portions 36Ac and 36Bc are shifted from each other, in a row-direction of the individual electrodes, by half the alignment pitch P (by P/2) for the rows of the pressure chambers 18*a*. Similarly, the conduction portions 36Dc and 36Ec are shifted from each other in the row-direction by P/2. The conduction portions 36Ac to 36Ec are arranged to correspond to the partition walls 27 between the pressure chambers 18*a* respectively.

Further, the conduction portions 36Ac to 36Ec of the individual inner-electrodes 36A to 36E in each of the first ceramic sheets 31 are arranged so that at least a part of each of the conduction portions 36Ac to 36Ec overlap in a plan view with one of conduction electrodes 41A, 41B, 41C, 41D, 41E and 41F arranged in rows in the second ceramic sheets 32 adjacent to the first ceramic sheet 31 in the up and down directions respectively, or with one of conduction electrodes 42A, 42B, 42C, 42D, 42E and 42F arranged in rows in the conduction-dummy ceramic sheet 33.

Furthermore, on each of the first ceramic sheets 31, a dummy common electrode 43 is formed at a portion at which a part of the dummy common electrode 43 overlaps in a plan view with the common electrode 37 (first belt-like portions 37A to 37G) in each of the second ceramic sheets 32, the portion being an outer periphery portion located on a surface of the first ceramic sheet 31 along the short and long sides thereof.

Figure 6:
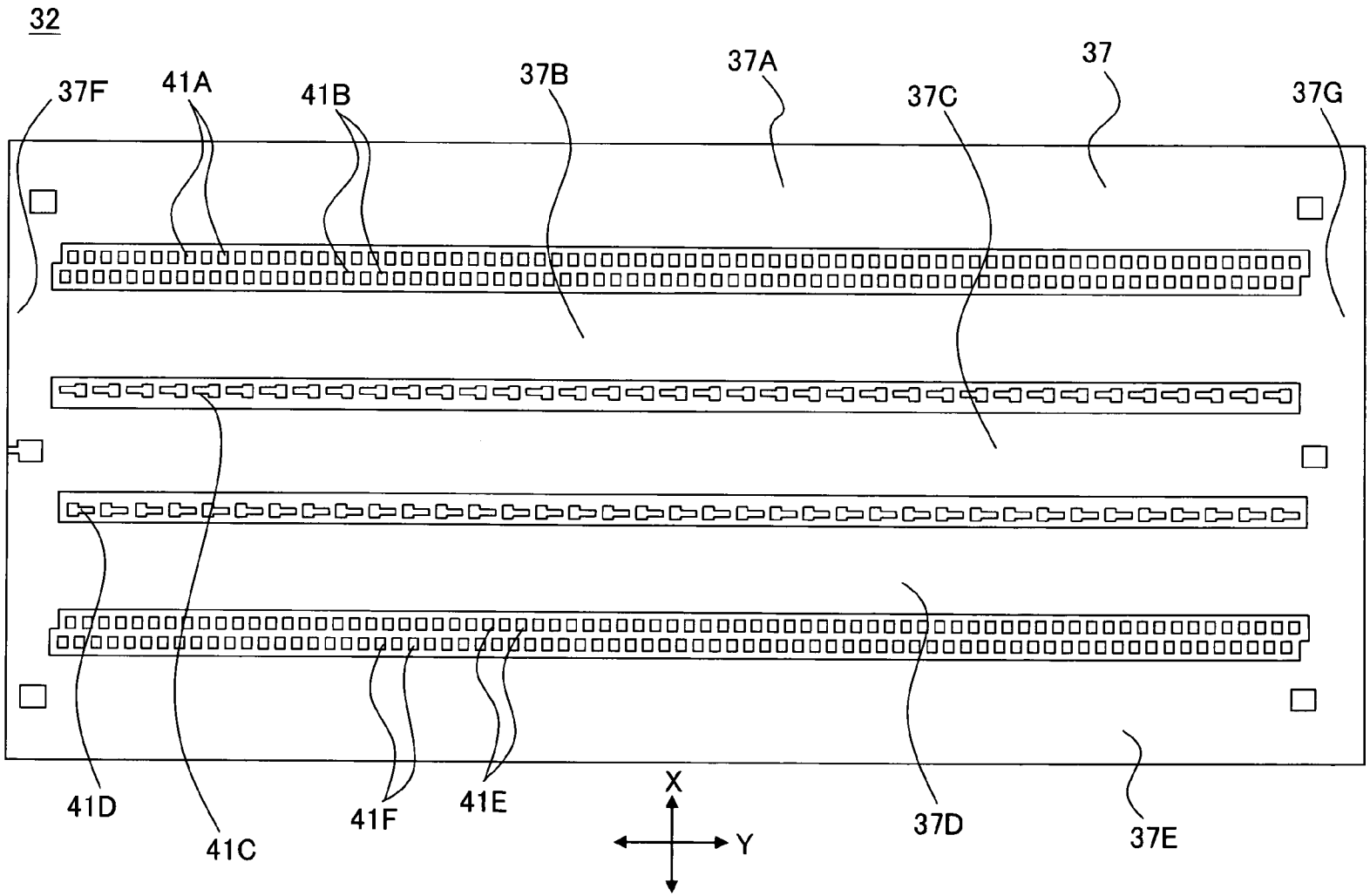
FIG. 6 is a plan view of a second piezoelectric ceramic sheet.

As shown in FIG. 6, the common inner-electrode (second electrode) 37 which is common to the pressure chambers 18*a* is arranged on a surface of each of the second ceramic sheets 32. The common inner-electrode 37 has five first belt-like portions 37A, 37B, 37C, 37D and 37E which face the individual inner-electrodes 36A, 36B and 36C, arranged in rows in the first ceramic sheet 31, in the stacking direction, and which extend in the row-direction; and the common inner-electrode 37 has second belt-like portions 37F and 37G which connect the first belt-like portions 37A to 37E at end portions in the longitudinal direction of the second ceramic sheet 32.

Between the first belt-like portions 37A to 37E, the conduction electrodes 41A to 41F are arranged in rows respectively. The conduction electrodes 41A to 41F correspond to the conduction portions 36Ac to 36Fc of the individual inner-electrodes 36A to 36F respectively. Namely, the common inner-electrode 37 surrounds the conduction electrodes 41A to 41F arranged in rows.

Note that the conduction electrodes 41C and 41D located at the central portion on the second ceramic sheet 32 are arranged in rows at a pitch in the row-direction twice a pitch at which conduction electrodes 41A, 41B, 41E and 41F located and arranged in rows at both sides of the rows of the conduction electrodes 41C and 41D, respectively. The conduction electrodes 41C and 41D correspond to the individual inner-electrodes 36Ca and 36Cb arranged in rows at the center of the first ceramic sheet 31, respectively.

Figure 7:
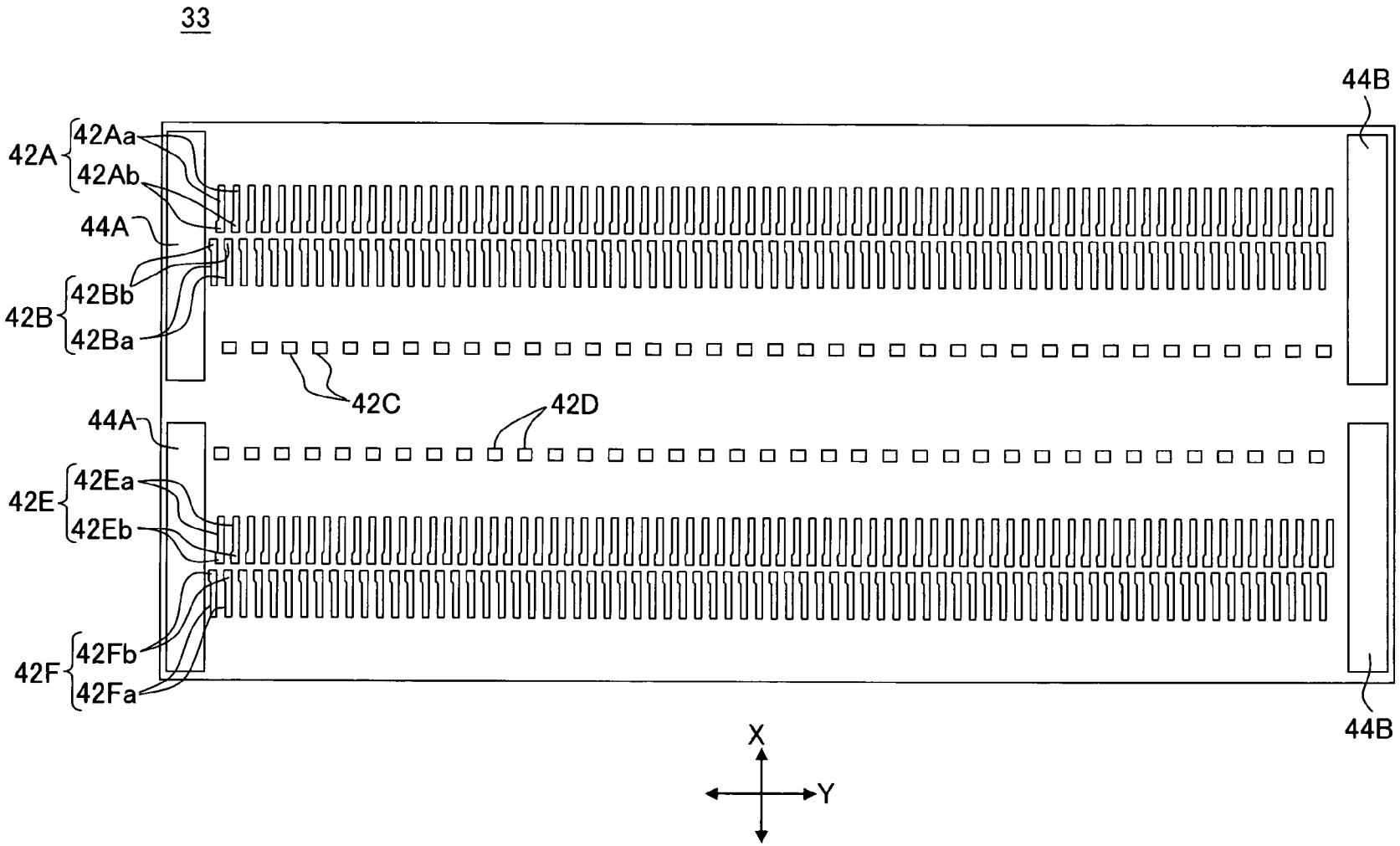
FIG. 7 is a plan view of a dummy ceramic sheet used for electrical conduction (dummy ceramic sheet for adjustment)

As shown in FIG. 7, on a surface of the conduction-dummy ceramic sheet 33, the connection electrodes 42A to 42F are arranged in rows. The connection electrodes 42A to 42F face and are parallel to the individual inner-electrodes 36A to 36E respectively in the stacking direction of the ceramic sheets.

The connection electrodes 42C, 42D located at the center on the conduction-dummy ceramic sheet 33 are arranged in rows at a pitch twice a pitch at which the connection electrodes 42A, 42B, 42E and 42F are arranged in rows at both sides of the rows of the connection electrodes 42C and 42D. The connection electrodes 42C and 42D correspond to the individual inner-electrodes 36Ca and 36Cb arranged in rows at the center of the first ceramic sheet 31, respectively. Further, the connection terminals 42C, 42D have a rectangular shape in plan view.

In end portions of the linear portions 42Aa, 42Ba, 42Ea and 42Fa, of the connection electrodes 42A, 42B, 42E and 42F, which correspond to portions above the partition walls 27 between adjacent pressure chambers 18*a*, rectangular portions 42Ab, 42Bb, 42Eb and 42Fb are formed respectively. The rectangular portions 42Ab, 42Bb, 42Eb and 42Fb have broader width than the linear portions 42Aa, 42Ba, 42Ea and 42Fa, and are connected to the conduction electrodes 41A, 41B, 41E and 41F via through holes 53A, respectively. The through holes 53A will be described later on.

On the upper surface of the conduction-dummy ceramic sheet 33, conduction electrodes 44A, 44B for the common inner-electrode (common-conduction electrodes 44A, 44B) are formed at portions along the short sides of the conduction-dummy ceramic sheet 33 respectively, namely at both end portions in the row-direction of the connection electrodes 42A to 42F. The common-conduction electrodes 44A, 44B are elongated in a direction orthogonal to the row-direction of the connection electrodes 42A to 42F, and are formed at positions at which the common-conduction electrodes 44A and 44B overlap with a part of the common inner-electrode 37 (belt-like portions 37F, 37G) in each of the second ceramic sheets 32 and overlap with a part of the dummy common electrode 43 in each of the first ceramic sheets 31.

Figure 8:
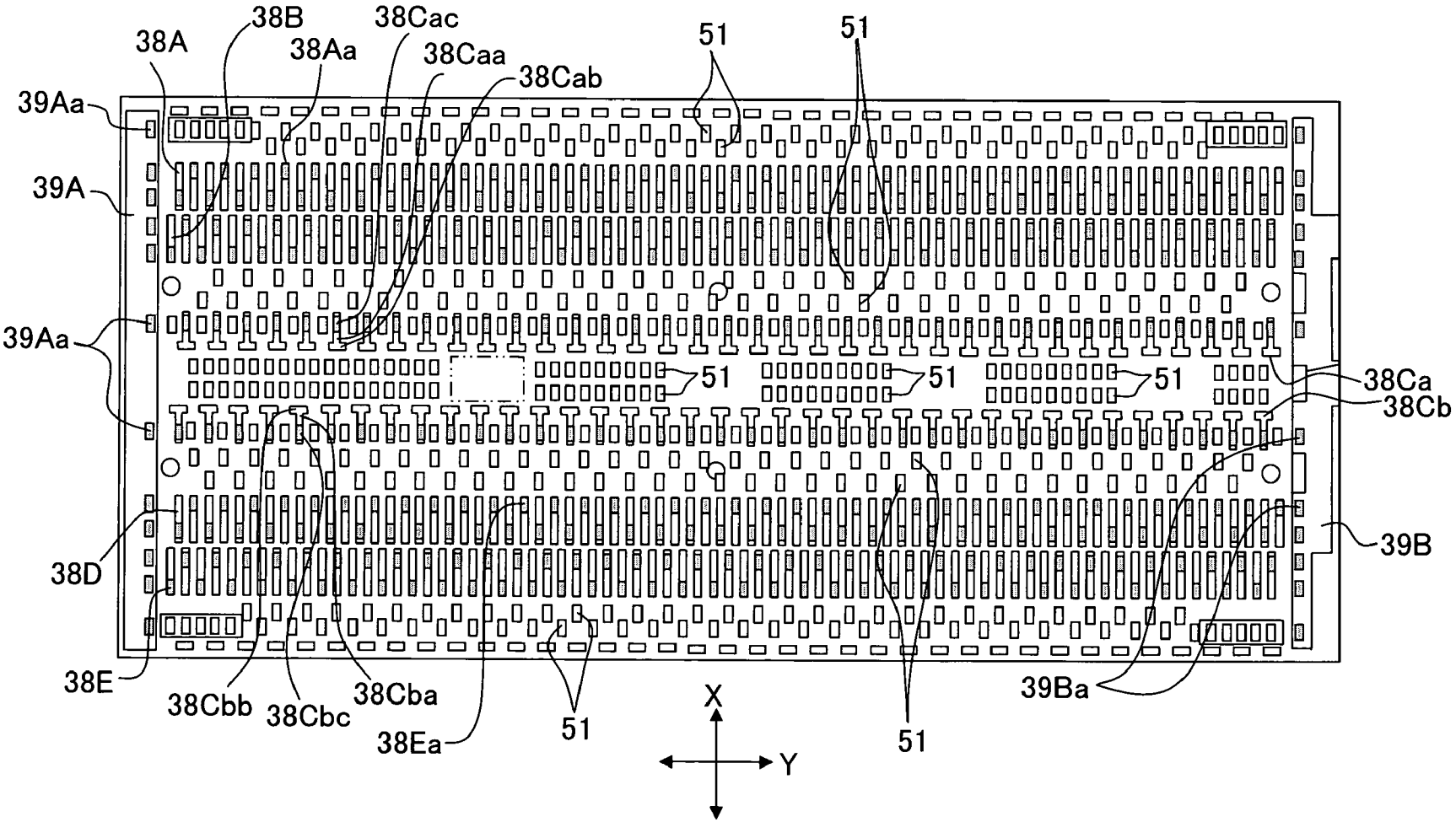
FIG. 8 is a plan view of a top ceramic sheet.

As shown in FIG. 8, on a surface of the top ceramic sheet 34, individual surface-electrodes (first surface electrodes) 38A, 38B, 38Ca, 38Cb, 38D, 38E are arranged in rows at positions corresponding to the connection electrodes 42A to 42F of the dummy ceramic sheet 33 respectively. On the surface of the top ceramic sheet 34, common surface-electrodes (second surface electrodes) 39A, 39B are formed at both end portions in the row-direction of the individual surface-electrodes 38A to 38E. The common surface-electrodes 39A and 39B are formed to be elongated in a direction orthogonal to the row-direction of the individual surface-electrodes 38A to 38E.

The individual surface-electrodes 38Ca, 38Cb located at the center on the top ceramic sheet 34 are formed in a T-shape (form of the alphabet letter "T") in a plan view, having first portions 38Caa, 38Cba extending in the X-direction and second portions 38Cab, 38Cbb connected to the inner end portions of the first portions 38Caa, 38Cba and extending in the Y-direction. The individual surface-electrodes 38Ca, 38Cb are arranged in two rows in a staggered manner such that the individual surface-electrodes 38Ca aligned in one row are shifted by half a pitch with respect to that for the individual surface-electrodes 38Cb aligned in the other row. As indicated as hatched portions in FIG. 8, joining electrode portions 38Cac, 38Cbc are formed on end portions of the second portions 38Cab, 38Cbb, respectively. The joining electrode portions 38Cac, 38Cbc are connected to connection terminals of the flexible flat cable 4 which will be described later on.

The individual surface-electrodes 38A, 38B, 38D and 38E located outside of the individual surface-electrodes 38Ca, 38Cb have a linear shape in a plan view, and are arranged in a staggered manner such that individual surface-electrodes belonging to a certain row is shifted from individual surface-electrodes belonging to another row adjacent to the certain row by half a pitch at which the individual surface-electrodes are aligned in each of the rows. As indicated as hatched portions in FIG. 8, joining electrode portions 38Aa, 38Ba, 38Da and 38Ea are formed on end portions of the individual surface-electrodes 38A, 38B, 38D and 38E, respectively. The joining electrode portions 38Aa, 38Ba, 38Da and 38Ea are connected to connection terminals of the flexible flat cable 4 which will be described later on. Here, each of these joining electrode portions is formed at any one of the both end portions of the individual surface-electrode, so that the joining electrode portions are located alternately at both ends in the row-direction of the individual surface-electrodes.

The individual surface-electrodes 38A to 38E are arranged at positions above the partition walls 27 (see FIG. 3) each of which is arranged between mutually adjacent pressure chambers 18*a* among the pressure chambers 18*a*. Here, the pressure chambers 18*a* are substantially parallel to the linear portion 36Aa to 36Ea of the individual inner-electrodes 36A to 36E respectively, and are arranged at positions below the linear portions 36Aa to 36Ea respectively. Therefore, the individual inner-electrodes 36A to 36E are arranged in rows at a pitch same as the pitch P for arranging the pressure chambers 18*a* in rows in the Y-direction, and the individual surface-electrodes 38A to 38E are arranged to overlap in a plan view with the pressure chambers 18*a* respectively. On the other hand, although the individual surface-electrodes 38A to 38E and the pressure chambers 18*a* are arranged in rows at a same pitch, the individual surface-electrodes 38A to 38E and the pressure chambers 18*a* are arranged to be mutually shifted by half the pitch. Accordingly, when the individual surface-electrodes 38A to 38E are connected to the connection terminals of the flexible flat cable 4, it is possible to receive by the partition walls 27*a* the pressing force generated during the connection. Thus, there is no fear that excessive pressing force acts to the portions, of the ceramic sheets, above the pressure chambers 18*a*, thereby preventing the ceramic sheet(s) from being broken or damaged.

Each of the common surface-electrodes 39A, 39B is formed on the top ceramic sheet 34 at an end portion in the longitudinal direction of the top ceramic sheet 34 to be elongated along one of the short sides thereof of the top ceramic sheet 34. Further, as indicated by hatched portions in FIG. 8, a plurality of joining electrode portions 39Aa and a plurality of joining electrode portions 39Ba are formed, on surfaces of the common surface-electrodes 39A and 39B, respectively, along the longitudinal direction of the common surface-electrodes 39A and 39B (in the short side of the top ceramic sheet 34). The joining-electrode portions 39Aa and 39Ba are connected to connection terminals of the flexible flat cable 4.

When the piezoelectric actuator is calcinated as described above, the surface electrodes (individual surface-electrodes and the common surface-electrodes) are also processed at a high temperature, which in turns lowers the joining performance of solder joining the surface electrodes and the connection terminals of the flexible flat cable 4. Therefore, the joining electrode portions 38Aa, 38Ba, 38Cac, 38Cbc, 38Da, 38Ea, 39Ab, 39Bb formed of a silver-based metal are adhered onto the surface electrodes formed of Ag—Pd based metal to thereby improve the joining performance between the surface electrodes and the connection terminals of the flexible flat cable 4.

A plurality of dummy electrodes 51, which do not contribute to the electrical conduction, are provided in a regular manner between the rows of the individual surface-electrodes 38Ca and 38Cb. The dummy electrodes 51 which do not contribute to the electrical conduction are also arranged on the top ceramic sheet 34 at a portion between the individual surface-electrodes 38B and 38Ca; at a portion between the individual surface-electrodes 38Cb and 38D; and at portions outside the individual surface-electrodes 38A and 38E respectively.

The arrangement of the dummy electrodes 51 is not limited to that shown in FIG. 8. It is enough that the dummy electrodes 51 described above are arranged in a balanced manner at positions at which the surface electrodes are arranged respectively, so as to prevent the joining force from lowering when the respective sheets are pressed to be integrated.

As shown in FIG. 4, a common inner-electrode 71 is formed entirely on the upper surface of the bottom ceramic sheet 35.

Figure 10A:
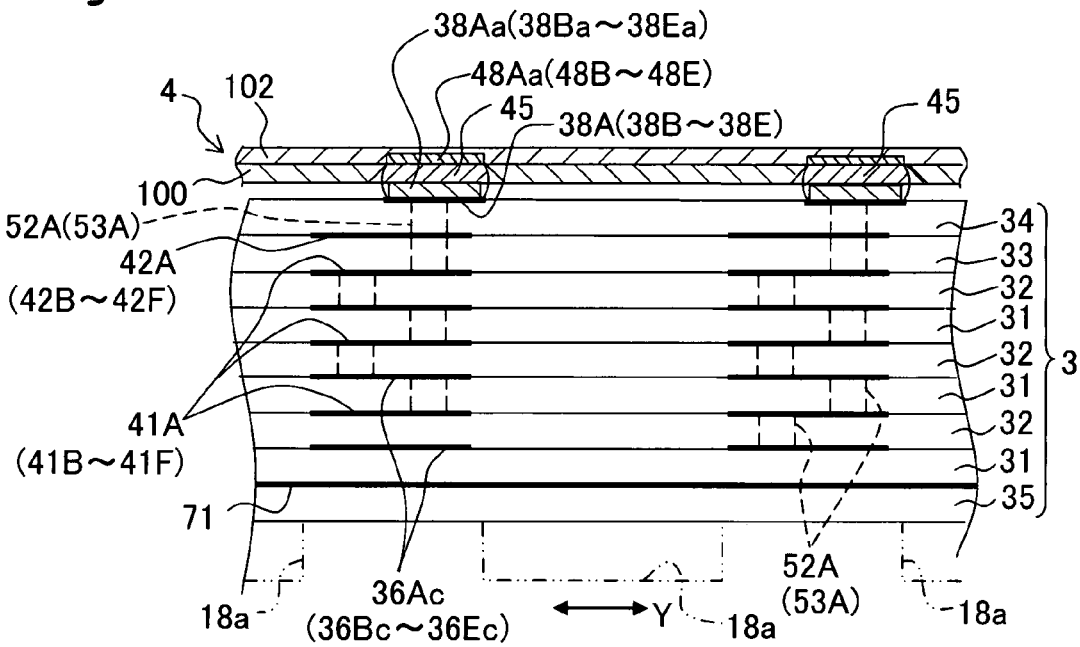
FIG. 10A is a sectional view for explaining the conduction relationship from individual inner-electrodes to individual surface-electrodes.
Figure 10B:
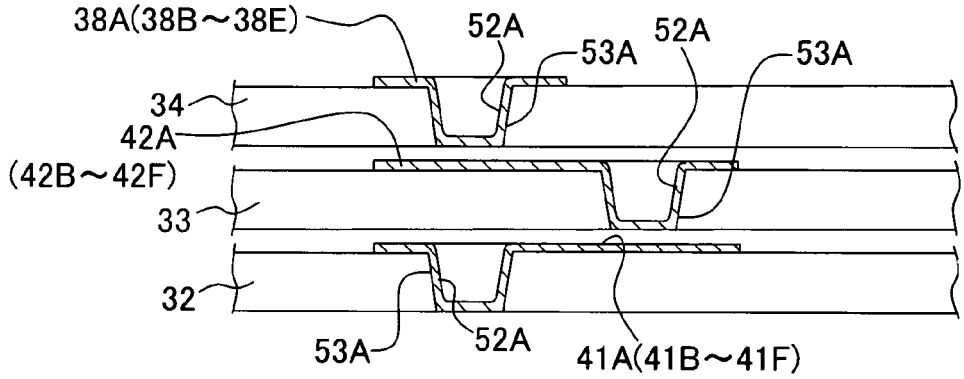
FIG. 10B is a view for explaining through holes.
Figure 11:
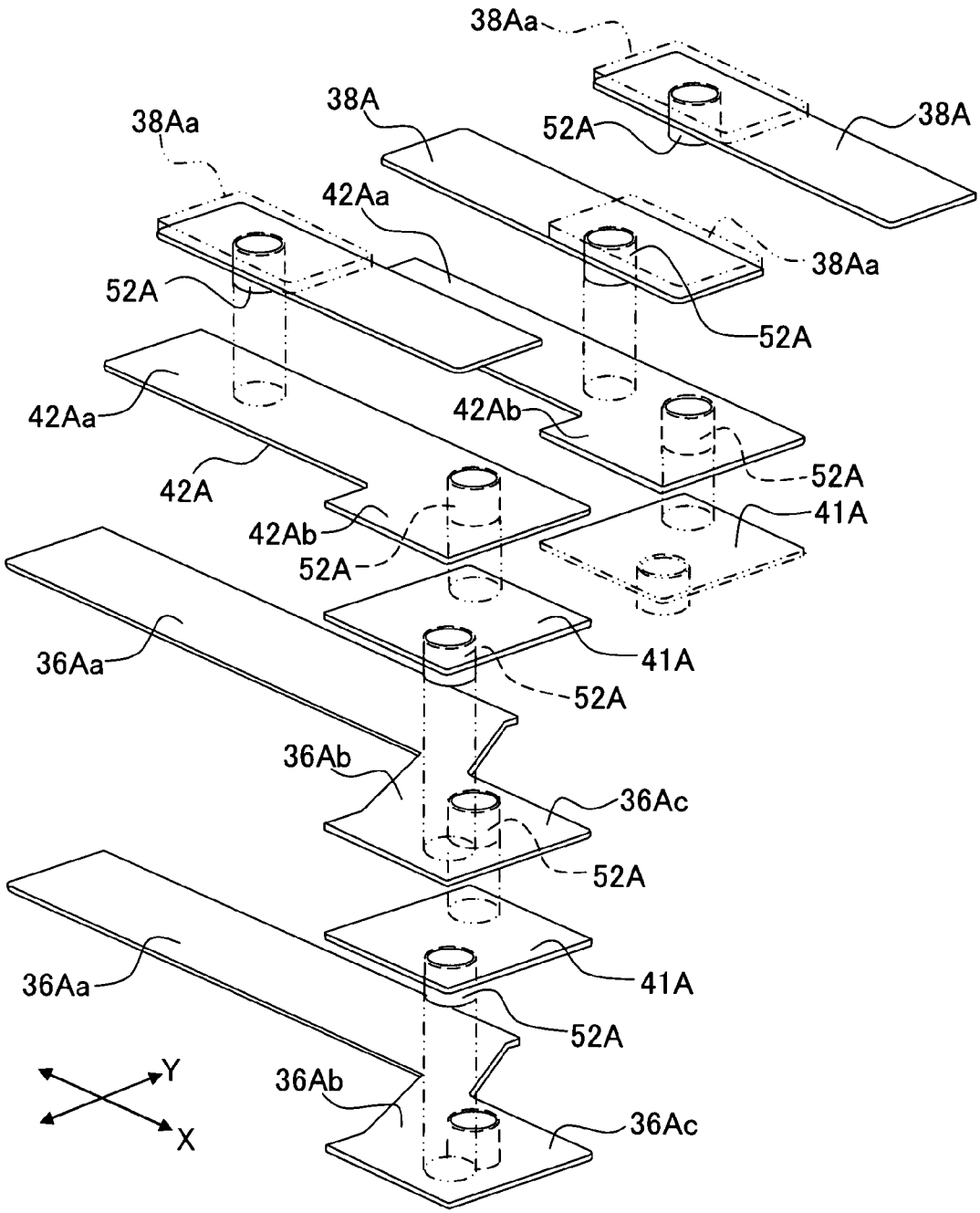
FIG. 11 is a perspective view for explaining the conduction relationship from the individual inner-electrodes to the individual surface-electrodes.

Other than the bottom ceramic sheet 35 as the lowermost layer in the actuator, the first and second ceramic sheets 31 and 32, the conduction-dummy sheet 33, and the top ceramic sheet 34 are provided with a plurality of through holes 53A, as shown in FIGS. 10A and 10B. The through holes 53A penetrate through the sheets 31 to 34 in the thickness direction thereof, and an electrically conductive paste is filled in the inside of the through holes 53A to form inner conduction electrodes 52A therein respectively. As shown in FIG. 11, the individual surface-electrodes 38A to 38E, the conduction portions 36Ac to 36Ec of the individual inner-electrodes 36A to 36E, the conduction electrodes (dummy-individual electrodes) 41A to 41F and the connection electrodes 42A to 42F are electrically connected to one another via the inner conduction electrodes 52A formed inside the through holes 53A formed in the ceramic sheets 31, 32, 33 and 34.

Furthermore, the plurality of through holes 53B penetrating through the piezoelectric ceramic sheets 31 to 34 in the thickness direction thereof are formed at positions corresponding to the electrodes 39A, 39B, 37, 71, 43, 44A and 44B respectively. Inside the through holes 53B, an electrically conductive material (electrically conductive paste) is filled to form inner conduction electrodes 52B.

Figure 10C:
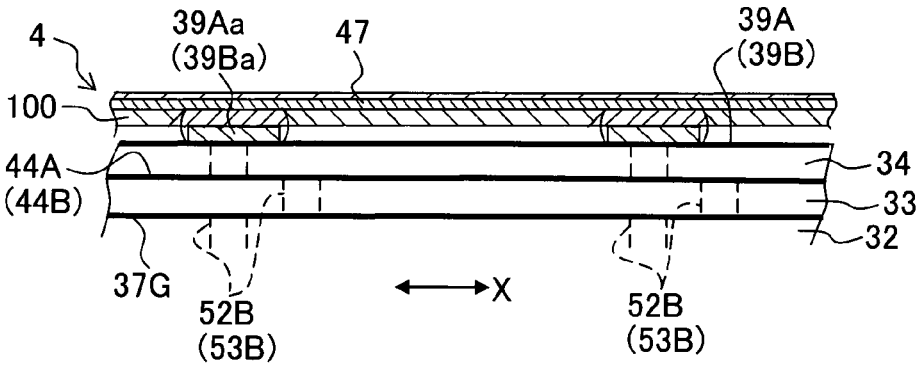
FIG. 10C is a sectional view for explaining the conduction relationship from common electrodes to surface electrodes.

The inner conduction electrodes 52A and the inner conduction electrodes 52B are formed in the ceramic sheets such that positions, at which the inner conduction electrodes 52A and 52B formed in a certain ceramic sheet respectively, do not overlap in a plan view with positions at which the inner conduction electrodes 52A and 52B formed in another certain ceramic sheets adjacent to the certain ceramic sheet (sandwiching the certain ceramic sheet) in the up and down direction. As shown in FIGS. 10B, 10C and 11, the through holes 53A, 53B are formed in the conduction dummy sheet 33 at positions which are shifted by a predetermined distance from positions at which the through holes 53A, 53B are formed in the top ceramic sheet 34. The through holes 53A, 53B are formed in the green sheets as the material for the ceramic sheets, and then the conductive material is coated on surfaces of the green sheets by the screen printing or the like. At this time, the conductive material is flowed into the through holes 53A, 53B to form the inner conductive electrodes 52A, 52B respectively. Therefore, as shown in FIGS. 10B and 10C, each of the inner conductive electrodes 52A, 53B is formed in a hollow shape opening on the side of the upper surface of the green sheet. Since the through holes are formed such that the through holes formed in two layers of the ceramic sheets adjacent in the up and down direction are located at positions which do not overlap with one another. Therefore, it is possible to avoid a situation in which through holes formed in the upper layer sheet are coaxially overlapped with through holes formed in the lower layer sheet, which would otherwise decrease contacting areas for the inner conduction electrodes 52A, 52B. Namely, by forming two adjacent through holes in the up and down direction to be shifted from each other, it is possible to make the bottom portions of the inner conduction electrodes 52A, 52B, formed to have a cup-shape in the upper layer sheet to have a surface-to-surface contact with the flat-shaped electrodes 42A (41A) formed on the lower layer sheet, thereby ensuring the electric conduction between the upper and lower layer sheets.

The individual surface-electrodes 38A, 38B, 38D and 38E and the connection electrodes 42A, 42B, 42D and 42E extend in a direction orthogonal to the row-direction in which the electrodes are aligned, and face one another and are parallel to one another respectively in the stacking direction. Further, the individual surface-electrodes 38A, 38B, 38D and 38E are connected to the connection electrodes 42A, 42B, 42D and 42E respectively such that a certain individual surface-electrode 38A among the individual surface-electrodes 38A is connected to a certain connection electrode 42A among the connection electrodes 42A corresponding to the certain individual-surface electrode 38A at a position different from another position at which another individual surface-electrode 38A adjacent to the certain individual surface-electrode 38A in the direction orthogonal to the row-direction, is connected to another connection electrode 42A corresponding to the another individual surface-electrode 38A. Specifically, as shown in FIG. 11, a certain individual surface-electrode 38A and a linear potion 42Aa of a certain connection electrode 42A corresponding to the certain individual surface-electrode 38A are connected to each other at one ends in the longitudinal direction of the certain individual surface-electrode and the linear potions 42Aa by the inner conduction-electrode 52A in the through hole. On the other hand, another individual surface-electrode 38A adjacent to the certain individual surface-electrode 38A and a linear potion 42Aa of another connection electrode 42A corresponding to the another individual surface-electrode 38A are connected to each other at other ends in the longitudinal direction of the another individual surface-electrode and the linear potions 42Aa by the inner conduction-electrode 52A in the through hole. Namely, in the row-direction, the individual surface-electrodes 38A and the connection electrodes 42A are connected to each other alternately at both ends of individual surface-electrodes in a staggered manner. The above-described arrangement is also applied same to the individual inner-electrodes 38B, 38D and 38E and to the connection electrodes 42B, 42D and 42E. Since the two adjacent individual surface-electrodes are connected to the connection electrodes at mutually different positions, it is possible to arrange a large number of through holes in a dispersed (non-concentrated manner), without arranging the large number of through holes adjacently in the row-direction. Accordingly, when the ceramic sheets are calcinated, it is possible to suppress the arching deformation or warpage of the ceramic sheets with the through holes as the base point of the arching deformation. Further, even when the number of the nozzles is increased and the number of the individual surface-electrodes 38A to 38E is increased for satisfying the demand in the recent years to increase the recording speed and realize higher resolution, there is no need to secure, outside the row of the individual inner-electrodes, wide connection area for the electrode connection, as required in the conventional actuator. Therefore, it is possible to easily realize a compact piezoelectric actuator. Furthermore, since the individual surface-electrode 38A to 38E face and are arranged in parallel to the connection electrodes 42A to 42F respectively in the stacking direction, the electrostatic capacitance which does not contribute to the displacement of the actuator is made to be uniform between the individual surface-electrodes 38A to 38E and the common inner-electrodes 37, 71.

Moreover, the connection electrodes 42A to 42E are formed to have a same length and a same width and are arranged in rows. Accordingly, areas of the portions, of the connection electrodes 42A to 42E, which face the common inner-electrode 37A to 37E located below the connection electrodes 42A to 42E respectively, are same among the connection electrodes 42A to 42F. Therefore, with respect to the connection electrodes 42A to 42E, the electrostatic capacitance between the connection electrodes 42A to 42E and the common inner-electrodes 37 and 71 is uniform. Since the connection electrodes are arranged to be shifted by half the pitch with respect to the linear portions of the individual inner-electrodes, the electrostatic capacitance between the connection electrodes and the individual inner-electrodes does not contribute to the jetting. Since the electrostatic capacitance can be made uniform, it is possible to make the characteristic of the piezoelectric actuator to be uniform among the individual surface-electrodes.

The joining electrode portions 38Aa, 38Ba, 38Cac, 38Cbc, 38Da and 38Ea on the individual surface-electrodes 38A to 38E are formed to cover the upper opening of the inner conduction electrodes 52A respectively, and the joining electrode portions 38Aa, 38Ba, 38Cac, 38Cbc, 38Da and 38Ea are connected alternately to both end portions of the electrodes 38A to 38E in the row-direction. Even when the inner conduction electrodes 52A are very thin in the through holes respectively, it is possible to reinforce the thinned inner conduction electrodes 52A in the through holes by inserting the joining electrode portions 38Aa to 38Ea up to the inside of the inner conduction electrodes 52A, thereby preventing the electrical disconnection in an assured manner.

Figure 9:
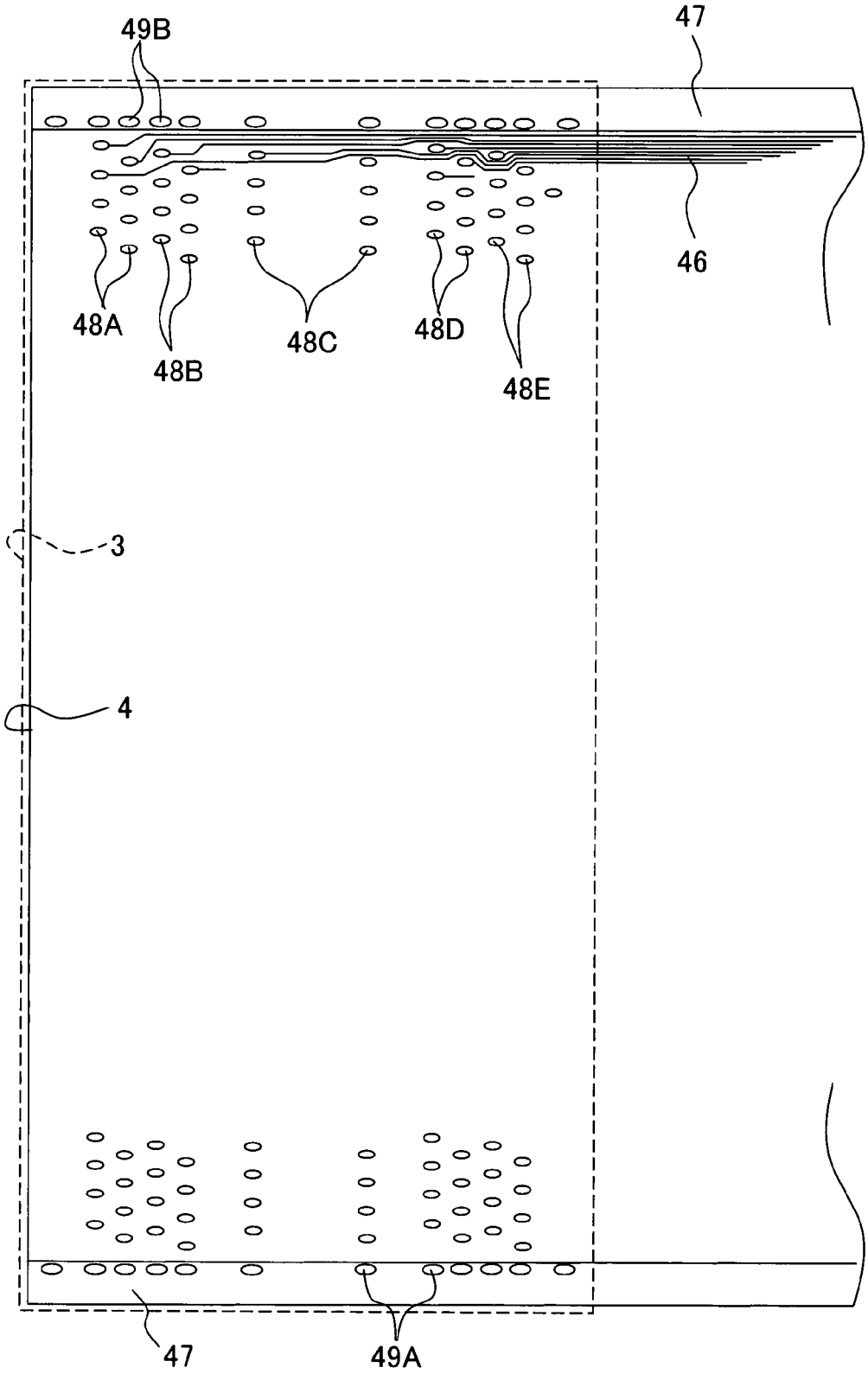
FIG. 9 is a plan view for explaining electrode arrangement in the flexible flat cable.

As shown in FIG. 1, the flexible flat cable 4 is overlaid with the upper surface of the top ceramic sheet 34 and arranged to be project outwardly from the top ceramic sheet 34 in a direction orthogonal to the nozzle rows (X-direction). The flexible flat cable 4 includes a belt-like shaped base member 100 made of flexible synthetic resin material having insulating property (for example, polyimide resin, polyester resin, polyamide resin, or the like); connection terminals 48A, 48B, 48C, 48D and 48E which are made of copper foil and which are formed on a surface of the base member 100 to correspond to the joining electrode portions 38Aa to 38Ea for the individual inner-electrodes respectively; and fine wirings 46 connected to the connection terminals 48A to 48E. Further, as shown in FIG. 9, connection terminals 49A, 49B are formed in the flexible flat cable 4 at positions overlapping with (corresponding to) the joining electrode portions 39Ab, 39Bb for the common inner-electrodes respectively; and wirings 47 which are connected to the connection terminals 49A, 49B respectively are provided on the flexible flat cable 4 along the both ends of the flexible flat cable 4. The wirings 47 are belt-like shaped and have a width greater than that of the wirings 46. These connection terminals and wirings are formed by the photoresist method or the like, and as shown in FIG. 10A, the surfaces of these terminals and wirings are covered by a cover lay 102 made of a flexible synthetic resin material having insulating property (for example, polyimide resin, polyester resin, polyamide resin, or the like).

The connection terminals 48A to 48E, 49A and 49B are exposed from the base member 100, and are joined to the joining electrode portions 38Aa to 38Ea, 39Ab and 39Bb for the individual inner-electrodes and the common inner-electrodes, respectively, with an electrically conductive brazing material (for example, solder) 45. Further, the wirings 47 are electrically joined to a driving integrated circuit 101 provided on the base member 101, thereby making it possible to selectively supply driving signals to the piezoelectric actuator.

The connection terminals 48A to 48E are arranged in rows corresponding to the joining electrode portions 38Aa to 38Ea for the individual inner-electrodes respectively, such that connection terminals are arranged in a staggered manner in each connection terminal row, and that a connection terminal in a certain row is arranged to be staggered with respect to another connection terminal in another row adjacent to the certain row. Therefore, it is possible to make the spacing distance great between the adjacent terminals 48A to 48E, and to draw the wirings 46 between the spacing distance among the rows such that the wirings 46 are not interfered with each other.

Areas (portions) of the ceramic sheets 31 and 32, between the individual inner-electrodes 36A to 36E and the common electrodes 37, 71 in the stacking direction, function as active portions (energy generating mechanism). Namely, the voltage is applied to portions (active portions) of the ceramic sheets between desired individual inner-electrodes 36A to 36E and the common electrodes 37, 71, to thereby making it possible to displace the active portions therebetween. By the displacement of the active portions, the jetting pressure is imparted to the ink in a certain pressure chamber 18*a*, among the pressure chambers 18*a*, corresponding to the desired active portions, thereby making an ink droplet jetted from a certain nozzle 11*a* among the nozzles 11*a* corresponding to the certain pressure chamber 18*a*.

Such active portions (energy generating mechanism) are formed at positions at which the active portions overlap with the pressure chambers 18*a* respectively, so that the active portions are provided in a one-to-one correspondence to the pressure chambers 18*a*. Namely, the active portions are arranged in the row-direction of the nozzles 11*a* (pressure chambers 18*a*), i.e. in the Y-direction, and are aligned in the X-direction in rows in a number same as that of the rows of the nozzles 11*a* (five rows in the embodiment). Further, the active portions are each formed to be elongated in the longitudinal direction of the pressure chamber 18*a*. The active portions are arranged in a staggered manner at spacing distances (intervals) same as those for the pressure chambers 18*a*.

Figure 12:
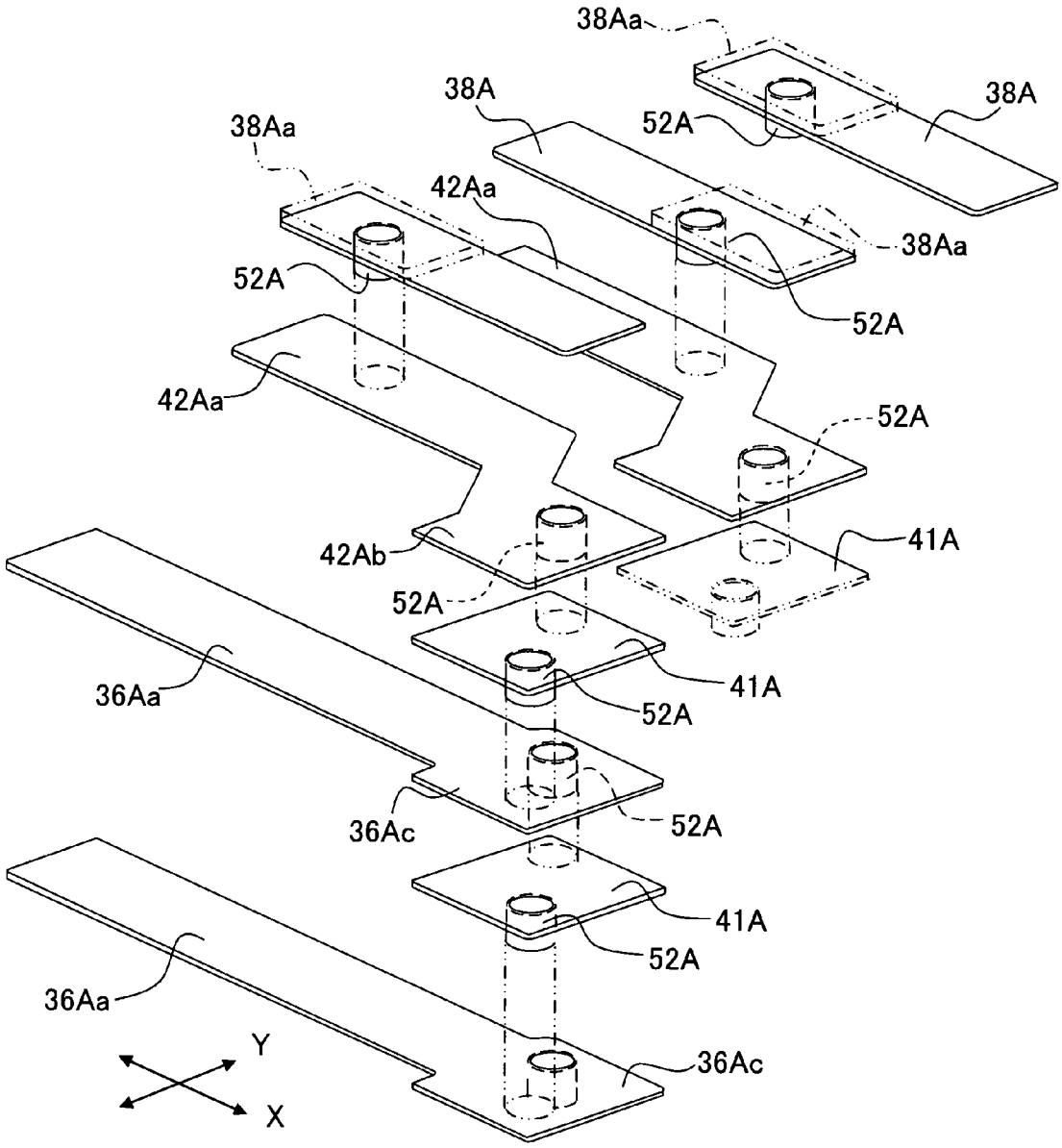
FIG. 12 is a perspective view for explaining the conduction relationship from the individual inner-electrodes to the individual surface-electrodes in another embodiment.

FIG. 12 shows another embodiment. In this embodiment, the individual inner-electrodes 36A have conduction portions 36Ac located at positions extended from linear portions 36Aa which are located to correspond to the pressure chambers 18*a* respectively. A position at which the conduction electrode 41 is connected to the conduction portion 36Ac and a position at which the joining electrode portion 42Ab in the dummy ceramic sheet 33 is connected to the conduction portion 36Ac are mutually different in a plan view. The connection electrodes 42A on the dummy ceramic sheet 33 have the linear portions 42Aa each of which is shifted by half the pitch with respect to the joining electrode portion 42Ab of one of the joining electrode portion 42Ab in the row-direction of the pressure chambers 18*a* to extend to a portion above the partition wall 27 between adjacent pressure chambers 18*a*. The individual surface-electrodes 38A are arranged to correspond to the linear portions 42Aa, at positions above the linear portions 42Aa respectively, and the individual surface-electrodes 38A are connected to the linear portions 42Aa, by the inner conduction electrodes 52A in the through holes, at portions located alternately at both ends in the row-direction of the individual surface-electrodes, in a similar manner as that in the above-described embodiment.

Note that the connection between the individual inner-electrodes 36B to 36E and the individual surface-electrodes 38B to 38E are constructed in a similar manner as that for the connection between the individual inner-electrodes 36A and the individual surface-electrodes 38A. In this embodiment also, same effects can be obtained as that in the above-described embodiment.

Figure 13:
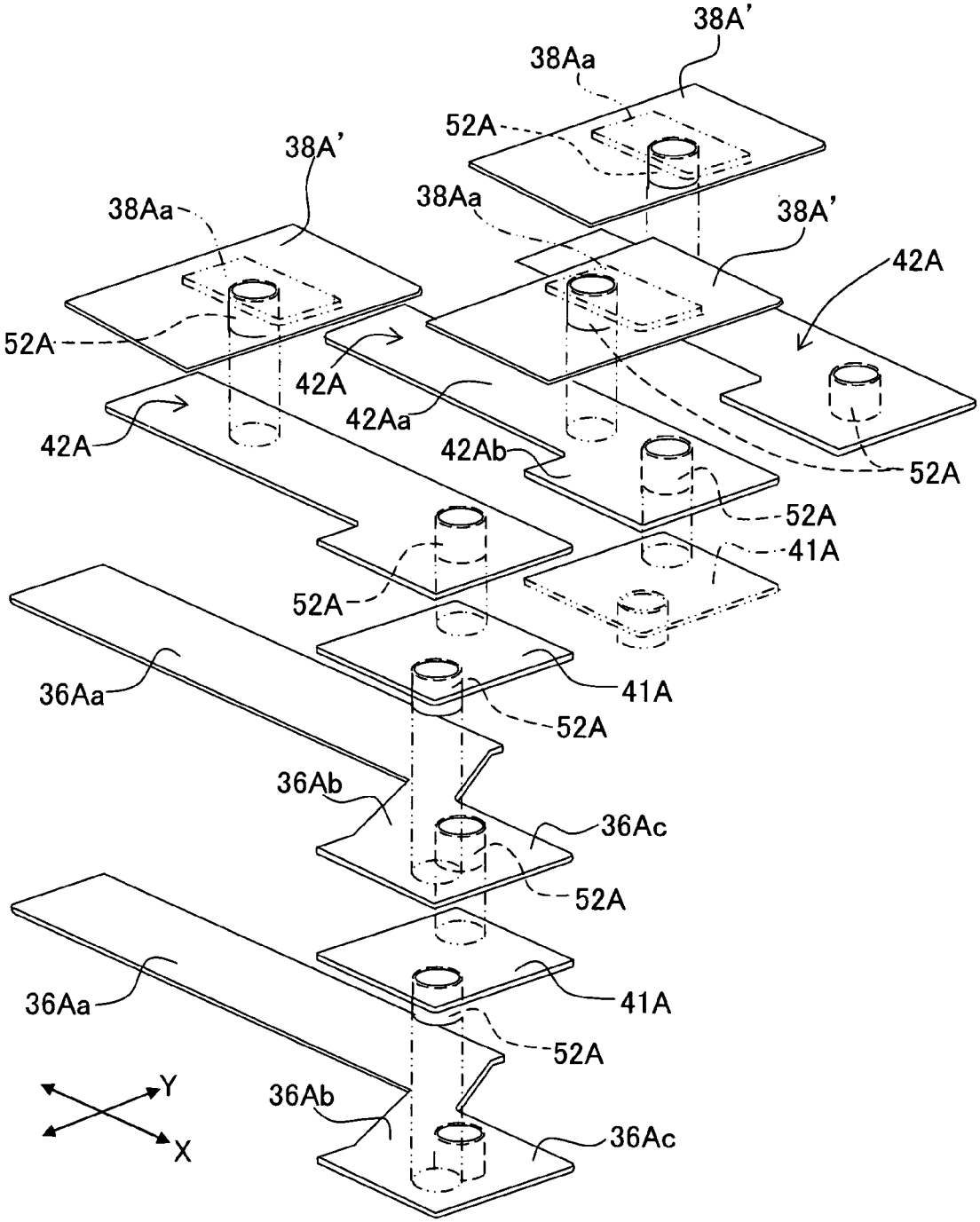
FIG. 13 is a perspective view for explaining the conduction relationship from the individual inner-electrodes to the individual surface-electrodes in still another embodiment.
Figure 14A:
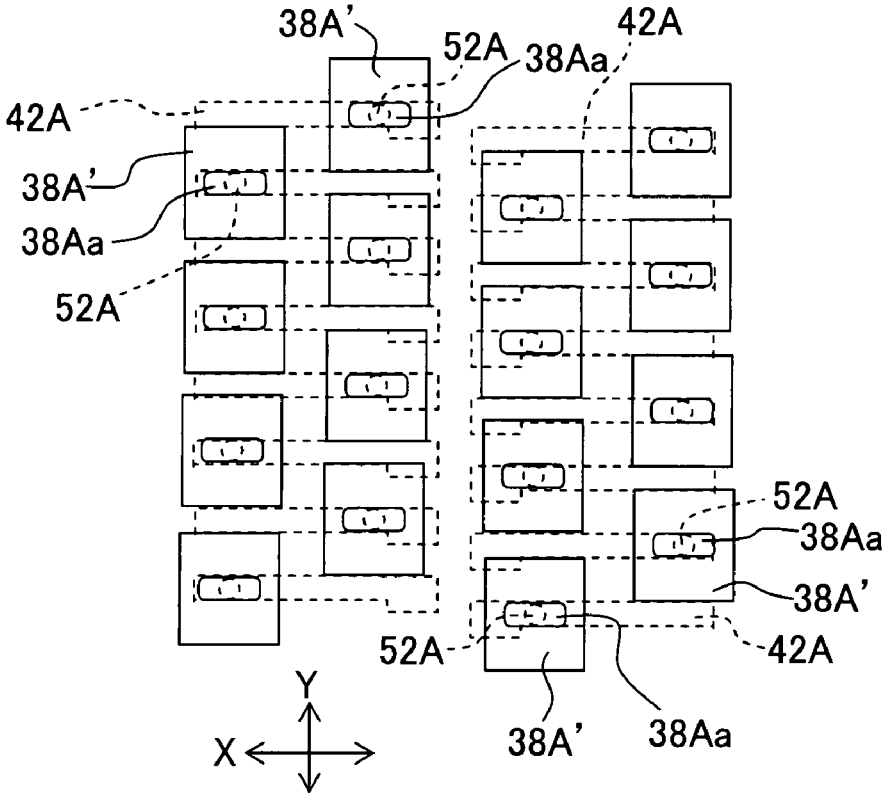
FIG. 14A is a plan view explaining the relationship between the joining electrodes and individual surface-electrodes in the embodiment of FIG. 13.
Figure 14B:
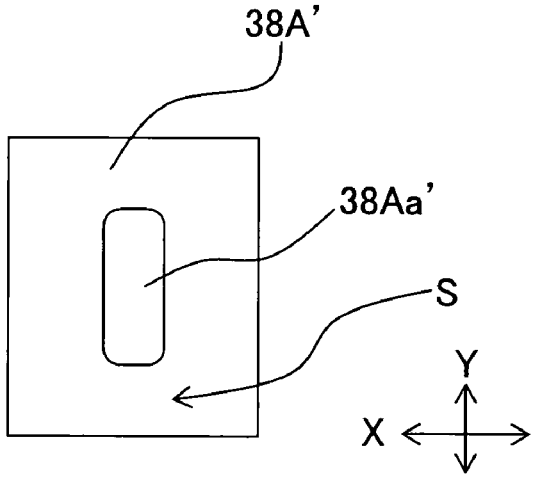
FIG. 14B is a view explaining a modification to the embodiment of FIG. 13.

FIGS. 13, 14A and 14B show still another embodiment of the present invention. In this embodiment, a plurality of connection electrodes 42A are arranged in rows in a row-direction (Y-direction), and each of the connection electrodes 42A extends in an orthogonal direction (X-direction) orthogonal to the row-direction. Individual surface-electrodes 38A' have a length in the X-direction which is about not more than half that of the connection electrodes 42A. The individual surface-electrodes 38A' are arranged, in the row-direction of the connection electrodes 42A, in a staggered manner to be located alternately at both end portions, of a linear portion 42Aa of each of the connection electrodes 42A, respectively. Namely, the individual surface-electrodes 38A' are arranged such that adjacent individual surface-electrodes 38A', among the individual surface-electrodes 38A', are arranged at mutually different positions in the X-direction and that the adjacent individual surface-electrodes face each of the connection electrode 42A, at the mutually different positions respectively.

Further, joining electrodes 38Aa are formed on the individual surface-electrodes 38A' respectively at positions corresponding to connection portions (inner conduction electrodes 52A formed in the through holes) of the individual surface electrodes 38A' at which the individual surface-electrodes 38A' are connected to the connection electrodes 42A respectively. The joining electrodes 38Aa are connected to terminal lines 48A to 48E of the signal lines 46 respectively. These joining electrodes 38Aa are arranged in the X-direction in a staggered manner corresponding to the connection terminals 48A to 48E arranged in rows in a staggered manner as shown in FIG. 9. Further, each of the individual surface-electrodes 38A' is formed to have a length and a width in the Y direction which are greater than those of one of the joining electrodes 38Aa. Since each of the individual surface-electrodes 38A' having a wide area is formed around one of the joining electrodes 38Aa, it is possible to stop (confine) an electrically conductive brazing material (for example, solder), used for joining the connection terminals 48A to 48E of the signal lines to the joining electrodes 38Aa, on the individual surface-electrodes 38A' respectively even when the blazing material is outflowed from the joining electrodes 38A'.

As shown in FIG. 14A, each of the individual surface-electrodes 38A' has portions which are located at both end portions in the row-direction (Y-direction) of each of the individual surface-electrodes 38A' and which overlap, in the X-direction, with the adjacent individual-surface electrodes 38A'. Namely, each of individual surface-electrodes 38A' has the length in the row-direction which is greater than a spacing distance in the row-direction between the individual surface-electrodes 38A'. Therefore, upon joining the connection terminals 48A to 48E of the signal lines 46 to the joining electrodes 38Aa, it is possible to increase, in the Y-direction, allowance for the positioning deviation of the joining electrodes 38Aa with respect to the individual surface-electrodes 38A'. In this case, the joining electrodes 38Aa' are arranged such that the longitudinal direction of the joining electrodes is coincident in an extending direction in which the signal lines extend so as to prevent the wiring pitch between the signal lines from being too integrated or dense. Alternatively, as shown in FIG. 14B, it is also possible that the joining electrodes 38Aa are arranged such that the longitudinal direction of the joining electrodes 38Aa is coincide with the row-direction of the joining electrodes 38Aa. In this case, in FIG. 14B, it is possible to make a non-overlapping portion S to be great in the longitudinal direction of the joining electrode 38Aa, the non-overlapping portion S being a portion at which each of the joining electrodes 38Aa does not overlap with one of the individual surface-electrodes 38A', which is effective in preventing the flow of electrically conductive blazing material. In addition, since the joining electrodes 38Aa overlaps assuredly in a plan view with the partition walls between adjacent pressure chambers, it is possible to receive, by the partition walls 27, pressing force generated upon joining the connection terminals of the flexible flat cable 4 to the individual surface-electrodes 38A', thereby preventing the ceramic sheet(s) from being cracked or broken.

Note that also in the embodiment shown in FIG. 13, it is possible to adopt a construction in which the linear portions 36Aa and the conduction portions 36Ac of the individual inner-electrodes 36A are formed to be arranged in a linear form, and in which the linear portions 42Aa and joining electrode portions 42Ab of the connection electrodes 42A are shifted by half the pitch, similarly to the embodiment shown in FIG. 12.

Also, it is allowable that the connection between the individual-inner electrodes 36B to 36E, other than the individual inner-electrodes 36A, and the individual surface-electrodes 36B to 36B, other than the individual surface-electrodes 36A, can be constructed in a similar manner as in the embodiment shown in FIG. 12 or 13. It should be noted that each of the piezoelectric actuators having the electrode arrangements shown in FIGS. 12 and 13 respectively can be joined to the cavity unit as described above to form an ink-jet head (liquid-droplet jetting head).

In the above-described embodiments, the individual surface-electrodes and the connection electrodes face each other and arranged in parallel to each other in the stacking direction. However, it is allowable that the individual surface-electrodes and the connection electrodes do not face each other and are not arranged in parallel to each other in the stacking direction.

What is claimed is:

1. A piezoelectric actuator on which connection terminals of signal lines transmitting a drive signal to the piezoelectric actuator are connected, the actuator comprising:

a plurality of ceramic sheets stacked in a predetermined stacking direction;

a plurality of individual inner-electrodes which are arranged in a row in a predetermined row-direction between the ceramic sheets;

a common inner-electrode which is arranged to face the individual inner-electrodes so that one ceramic sheet, among the ceramic sheets, is sandwiched between the common inner-electrode and the individual inner-electrodes;

a plurality of individual surface-electrodes which are arranged on a top surface of the stacked ceramic sheets, and which are connected to the individual inner-electrodes respectively;

a common surface-electrode which is arranged on the top surface of the stacked ceramic sheets, and which is connected to the common inner-electrode; and a plurality of connection-electrodes which are arranged on another ceramic sheet, among the ceramic sheets, between the individual surface-electrodes and the individual inner-electrodes, which face in parallel to the individual surface-electrodes respectively in the stacking direction, and which are arranged in a row in the row-direction corresponding to the individual surface-electrodes respectively, each of the connection-electrodes connecting one of the individual surface-electrodes and one of the individual inner-electrodes, and having an area enough to cover one of the individual surface-electrodes corresponding to each of the connection-electrodes;

wherein two individual surface-electrodes, among the plurality of individual surface-electrodes, which are adjacent to each other in the row-direction, are connected to two connection electrodes, among the plurality of connection electrodes, corresponding to the two individual surface-electrodes, at mutually different positions in an orthogonal direction orthogonal to the row-direction, respectively.

2. The piezoelectric actuator according to claim 1, wherein the individual surface-electrodes are connected to the connection terminals of the signal lines at positions corresponding to connection portions of the individual surface-electrodes at which the individual surface-electrodes are connected to the connection electrodes, respectively.

3. The piezoelectric actuator according to claim 2, wherein the individual surface-electrodes and the connection electrodes extend in the orthogonal direction; and joining electrodes connected to the connection terminals of the signal lines are formed on the individual surface-electrodes at the positions corresponding to the connection portions.

4. The piezoelectric actuator according to claim 3, wherein the connection electrodes have portions which face the common inner-electrode located on a side opposite to the individual surface-electrodes, area of the portions being same among the connection electrodes.

5. The piezoelectric actuator according to claim 1, wherein the plurality of ceramic sheets include a first ceramic sheet having the individual inner-electrodes formed thereon, a second ceramic sheet having the common inner-electrode formed thereon, a third ceramic sheet having the individual surface-electrodes and the common surface-electrode formed thereon, and a fourth ceramic sheet having the connection electrodes formed thereon; and through holes are formed in the individual inner-electrodes and the connection electrodes respectively, and an electrically conducted material is filled in the through holes to connect between the individual inner-electrodes and the connection electrodes respectively.

6. The piezoelectric actuator according to claim 5, wherein a cavity unit is joined to a bottom surface, of the stacked ceramic sheets, which is on a side opposite to the top surface, the cavity unit including a plurality of nozzles each jetting a liquid-droplet of a liquid and a plurality of pressure chambers corresponding to the nozzles respectively and being arranged in a row; and the individual inner-electrodes are arranged to face the pressure chambers respectively, and when a voltage is applied between the individual inner-electrodes and the common inner-electrode, portions of at least one of the first and second ceramic sheets between the individual inner-electrodes and the common inner-electrode to which the voltage is applied are displaced to impart jetting pressure to the liquid in the pressure chambers.

7. The piezoelectric actuator according to claim 6, wherein the pressure chambers are arranged in a plurality of rows in the cavity unit;

the individual inner-electrodes are arranged in a plurality of rows corresponding to the rows of the pressure chambers respectively;

the common inner-electrode faces the rows of the individual inner-electrodes in the stacking direction and extends in the row-direction in which the rows of the individual inner-electrodes extend;

the connection electrodes are arranged in a plurality of rows and the individual surface-electrodes are arranged in a plurality of rows corresponding to the rows of the individual inner-electrodes; and the common surface-electrode extends, in a same plane with the individual surface-electrodes, along an end portion of the third ceramic sheet which is orthogonal to the row-direction.

8. The piezoelectric actuator according to claim 3, wherein the joining electrodes are arranged in a row in a staggered manner in the orthogonal direction.

9. The piezoelectric actuator according to claim 8, wherein the connection electrodes extend in the orthogonal direction;

the plurality of individual surface-electrodes are arranged such that individual surface-electrodes, among the plurality of individual surface-electrodes, which are mutually adjacent are located on the top surface at positions which are mutually different in the orthogonal direction respectively; and the adjacent individual surface-electrodes face each of the connection electrodes at positions of each of the connection electrodes which are mutually different in the orthogonal direction respectively.

10. The piezoelectric actuator according to claim 9, wherein the joining electrodes are formed on the individual surface-electrodes at positions corresponding to the connection portions.

11. The piezoelectric actuator according to claim 10, wherein the joining electrodes are arranged in a row in a staggered manner in the orthogonal direction; and each of the individual surface-electrodes is formed to have a length and a width in the row-direction which are greater than those of one of the joining electrodes.

12. The piezoelectric actuator according to claim 11, wherein each of the individual surface-electrodes has a length in the row-direction which is greater than a spacing distance in the row-direction between the individual surface-electrodes.

13. The piezoelectric actuator according to claim 11, wherein each of the plurality of individual surface-electrodes has end portions, and the adjacent individual surface-electrodes overlap in the orthogonal direction at the end portions thereof.

14. A liquid-droplet jetting head which jets a liquid-droplet of a liquid, comprising:

a cavity unit having a plurality of nozzles each of which jets the liquid-droplet, and a plurality of pressure chambers which correspond to the nozzles respectively and which are arranged in a row at a predetermined pitch in a predetermined row-direction; and a piezoelectric actuator which is joined to the cavity unit, including:

a first ceramic sheet on which a plurality of individual inner-electrodes are arranged in a row corresponding to the pressure chambers respectively;

a second ceramic sheet which is stacked on the first ceramic sheet and on which a common inner-electrode is formed, the common inner-electrode being common to the pressure chambers and facing the individual inner-electrodes;

a third ceramic sheet which is stacked on an outermost layer of the stacked first and second ceramic sheets, and on which a plurality of individual surface-electrodes connected to the individual inner-electrodes respectively and a common surface-electrode connected to the common inner-electrode are formed; and a fourth ceramic sheet which is stacked between the first and third ceramic sheets and on which a plurality of connection electrodes are formed, the connection-electrodes each connecting one of the individual surface-electrodes and one of the individual inner-electrodes, and each having an area enough to cover one of the individual surface-electrodes;

wherein two individual surface-electrodes, among the plurality of individual surface-electrodes, which are adjacent to each other in the row-direction, are connected to two connection electrodes, among the plurality of connection electrodes, corresponding to the two adjacent inner surface-electrodes, at mutually different positions in an orthogonal direction orthogonal to the row-direction, respectively.

15. The liquid-droplet jetting head according to claim 14, further comprising signal lines which transmit, to the piezoelectric actuator, a driving signal for driving the piezoelectric actuator, and which has connection terminals connected to the individual surface-electrodes and the common surface-electrode.

16. The liquid-droplet jetting head according to claim 14, wherein the connection electrodes include first portions, second portions, and third portions respectively, the first portions being arranged in the row-direction at a pitch, each of the first portions facing one of the individual surface-electrodes in the stacking direction and being connected to one of the individual surface-electrodes, each of the second portions facing one of the individual inner-electrodes in the stacking direction, being connected to one of the individual inner-electrodes, and being arranged in the row-direction to be shifted with respect to one of the first portions by half the pitch, and the third portions connecting the first portions and the second portions respectively.

17. The liquid-droplet jetting head according to claim 15, wherein the individual surface-electrodes are connected to the connection terminals of the signal lines at positions corresponding to connection portions of the individual surface-electrodes at which the individual surface-electrodes are connected to the connection electrodes, respectively.

18. The liquid-droplet jetting head according to claim 17, wherein the individual surface-electrodes and the connection electrodes extend in the orthogonal direction orthogonal to the row-direction; and joining electrodes connected to the connection terminals of the signal lines are formed on the individual surface-electrodes at the positions corresponding to the connection portions.

19. The liquid-droplet jetting head according to claim 18, wherein the connection electrodes have portions which face the common inner-electrode located on a side opposite to the individual surface-electrodes, area of the portions being same among the connection electrodes.

20. The liquid-droplet jetting head according to claim 14, wherein through holes are formed in each of the first, second, third and fourth sheets at areas sandwiched between the individual inner-electrodes and the second portions of the connection electrodes respectively and at another areas sandwiched between the individual surface-electrodes and the first portions of the connection electrodes respectively; and an electrically conducted material is filled in the through holes to connect between the individual inner-electrodes and the second portions of the connection electrodes and between the individual surface-electrodes and the first portions of the connection electrodes respectively.

21. The liquid-droplet jetting head according to claim 14, wherein the individual inner-electrodes are arranged to face the pressure chambers respectively, and when a voltage is applied between the individual inner-electrodes and the common inner-electrode, portions of at least one of the first and second ceramic sheets between the individual inner-electrodes and the common inner-electrode to which the voltage is applied are displaced to impart jetting pressure to the liquid in the pressure chambers.

22. The liquid-droplet jetting head according to claim 21, wherein the pressure chambers are arranged in a plurality of rows in the cavity unit;

the individual inner-electrodes are arranged in a plurality of rows in the row-direction to correspond to the rows of the pressure chambers respectively;

the common inner-electrode faces the rows of the individual inner-electrodes in the stacking direction and extends in the row-direction in which the rows of the individual inner-electrodes extend;

the connection electrodes are arranged in a plurality of rows and the individual surface-electrodes are arranged in a plurality of rows corresponding to the rows of the individual inner-electrodes; and the common surface-electrode extends, in a same plane with the individual surface-electrodes, along an end portion of the third ceramic sheet which is orthogonal to the row-direction.

* * * * *